US009417540B2

(12) United States Patent
Hashimoto et al.

(10) Patent No.: US 9,417,540 B2
(45) Date of Patent: Aug. 16, 2016

(54) TONER AND TWO-COMPONENT DEVELOPER

(71) Applicant: CANON KABUSHIKI KAISHA, Tokyo (JP)

(72) Inventors: Takeshi Hashimoto, Moriya (JP); Hideki Kaneko, Yokohama (JP); Nozomu Komatsu, Toride (JP); Takakuni Kobori, Toride (JP); Yosuke Iwasaki, Abiko (JP); Ichiro Kanno, Abiko (JP); Kohji Takenaka, Toride (JP); Hiroyuki Fujikawa, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/568,727

(22) Filed: Dec. 12, 2014

(65) Prior Publication Data

US 2015/0185650 A1 Jul. 2, 2015

(30) Foreign Application Priority Data

Dec. 26, 2013 (JP) ..... 2013-269462

(51) Int. Cl.
*G03G 9/087* (2006.01)
*G03G 9/08* (2006.01)

(52) U.S. Cl.
CPC ..... *G03G 9/081* (2013.01); *G03G 9/08755* (2013.01); *G03G 9/08793* (2013.01); *G03G 9/08797* (2013.01)

(58) Field of Classification Search
CPC ..... G03G 9/08755; G03G 9/08748
USPC ..... 430/109.4
See application file for complete search history.

(56) References Cited

U.S. PATENT DOCUMENTS

| | | | | |
|---|---|---|---|---|
| 5,057,392 | A * | 10/1991 | McCabe | G03G 9/08755 430/109.2 |
| 5,294,682 | A * | 3/1994 | Fukuda | G03G 9/08755 430/109.2 |
| 5,747,210 | A * | 5/1998 | Emoto | G03G 9/08755 430/109.4 |
| 6,203,959 | B1 | 3/2001 | Tanikawa et al. | |
| 7,279,262 | B2 | 10/2007 | Fujikawa et al. | |
| 7,396,626 | B2 | 7/2008 | Fujikawa et al. | |
| 7,858,283 | B2 | 12/2010 | Ishigami et al. | |
| 7,927,775 | B2 | 4/2011 | Komatsu et al. | |
| 7,939,233 | B2 | 5/2011 | Inoue et al. | |
| 7,951,518 | B2 | 5/2011 | Ono et al. | |
| 8,137,886 | B2 | 3/2012 | Baba et al. | |
| 8,288,069 | B2 | 10/2012 | Fujikawa et al. | |
| 2004/0131961 | A1 | 7/2004 | Watanabe et al. | |
| 2010/0196812 | A1 * | 8/2010 | Koike | G03G 9/08755 430/108.4 |
| 2013/0288173 | A1 | 10/2013 | Hashimoto et al. | |
| 2013/0316282 | A1 | 11/2013 | Ishigami et al. | |
| 2014/0030650 | A1 | 1/2014 | Komatsu et al. | |
| 2015/0086917 | A1 | 3/2015 | Iwasaki et al. | |

FOREIGN PATENT DOCUMENTS

| | | | | |
|---|---|---|---|---|
| EP | 1 271 255 | A1 | | 1/2003 |
| JP | 10239903 | A | * | 9/1998 |
| JP | 2000242030 | A | * | 9/2000 |
| JP | 2003-280243 | A | | 10/2003 |
| JP | 2008-122931 | A | | 5/2008 |
| JP | 2009-175755 | A | | 8/2009 |
| JP | 2013-33176 | A | | 2/2013 |
| JP | 2013-105074 | A | | 5/2013 |

OTHER PUBLICATIONS

English language machine translation of JP 10-239903 (Sep. 1998).*
English language machine translation of JP 2000-242030 (Sep. 2000).*
European Search Report dated May 8, 2015 in European Application No. 14004323.3.
Mark, "Phenolic Resins", Encyclopedia of Polymer Science and Technology, Third Edition, 2003, vol. 7, pp. 322-367.

* cited by examiner

*Primary Examiner* — Christopher Rodee
(74) *Attorney, Agent, or Firm* — Fitzpatrick, Cella, Harper & Scinto

(57) ABSTRACT

Provided is a toner obtained by melting and kneading a binder resin containing a polyester resin A and a polyester resin B, a colorant, and a wax, in which in the resin A, the content of a polyhydric alcohol unit derived from an aromatic diol, the content of a polyhydric alcohol unit derived from an oxyalkylene ether of a novolac type phenol resin, and the content of a polyvalent carboxylic acid unit derived from an aliphatic dicarboxylic acid, which contains a straight-chain hydrocarbon having 4 or more to 16 or less carbon atoms as a main chain and has carboxyl groups at both of its terminals, fall within specific ranges, and in the resin B, the content of a polyhydric alcohol unit derived from an aromatic diol and the content of a polyvalent carboxylic acid unit derived from an aromatic dicarboxylic acid or a derivative thereof fall within specific ranges.

6 Claims, 1 Drawing Sheet

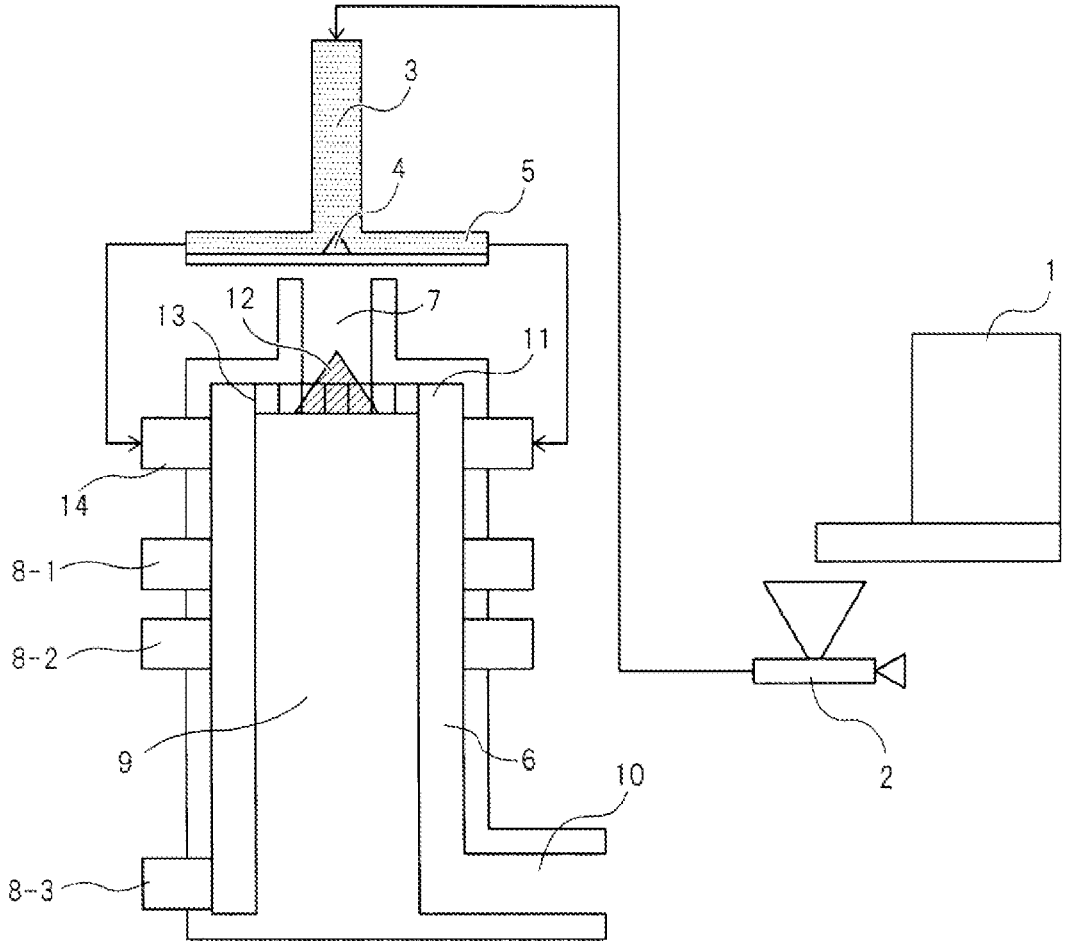
3
4
5
1
12
7
13
11
14
8-1
8-2
9
6
10
2
8-3

TONER AND TWO-COMPONENT DEVELOPER

BACKGROUND OF THE INVENTION

1. Field of the Invention

The present invention relates to a toner and a two-component developer to be used in an electrophotographic system, an electrostatic recording system, an electrostatic printing system, or a toner jet system.

2. Description of the Related Art

In recent years, requirements for an increase in printing speed and correspondence to energy savings have been additionally growing in association with the widespread use of a full-color copying machine of an electrophotographic system. A technology for melting a toner in an additionally quick manner in a fixing step has been studied for corresponding to high-speed printing. In addition, a technology by which the toner is fixed at an additionally low fixation temperature in order that a power consumption in the fixing step may be reduced has been studied as measures to correspond to the energy savings.

The following method is available for corresponding to the high-speed printing and improving the low-temperature fixability of the toner. The glass transition point and softening point of the binder resin of the toner are reduced, and a binder resin having sharp-melt property is used. In recent years, a polyester resin has been used as a sharp-melt resin suitable for the high-speed printing. On the other hand, the hot offset resistance of a toner that achieves low-temperature fixability is apt to reduce. Accordingly, a toner that can achieve compatibility between its low-temperature fixability and hot offset resistance has been required.

A toner containing polyester resins having different softening points has been studied in order that compatibility between low-temperature fixability and hot offset resistance may be achieved. For example, Japanese Patent Application Laid-Open No. 2003-280243 proposes such a toner that a value for a loss tangent in the range of a loss modulus G" of from $1\times10^4$ Pa or more to $1\times10^6$ Pa or less and the range of a loss tangent at a loss modulus G" of $1\times10^3$ Pa are specified. According to Japanese Patent Application Laid-Open No. 2003-280243, a toner that contains a polyester resin containing novolac as a constituent unit, and hence easily achieves characteristic viscoelasticity and has high-speed fixability is obtained.

In addition, Japanese Patent Application Laid-Open No. 2008-122931 proposes a resin for a toner formed of a polyester resin formed of: a linear polyester that has an acid value of from 50 mgKOH/g or more to 200 mgKOH/g or less, and whose glass transition point and flow softening point satisfy a specific relationship; and a nonlinear polyester.

In addition, Japanese Patent Application Laid-Open No. 2013-105074 proposes a toner binder that contains two polyester resins different from each other in softening point and weight-average molecular weight, and whose ratio between loss tangents at specific temperatures falls within a specific range. Japanese Patent Application Laid-Open No. 2013-105074 describes that when an alkane dicarboxylic acid and/or alkene dicarboxylic acid having 4 or more to 8 or less carbon atoms are each/is incorporated at a content of from 0.1 mol % or more to 10 mol % or less into the polycarboxylic acid component of a polyester resin, the storage stability of a toner and the transparency of the binder upon its use in the toner are good. In addition, the literature describes that when a polyoxyalkylene ether of a novolac resin is incorporated at a content of from 0.02 mol % or more to 10 mol % or less into the polyol component of a polyester resin, the storage stability of the toner is good.

The toner described in Japanese Patent Application Laid-Open No. 2003-280243, and a toner using the resin for a toner described in Japanese Patent Application Laid-Open No. 2008-122931 or the toner binder described in Japanese Patent Application Laid-Open No. 2013-105074 each have some levels of low-temperature fixability and hot offset resistance by virtue of which the toner is applicable to high-speed printing. However, when any such toner is applied to high-speed printing required in recent years in which images are printed on about 100 sheets of paper per minute, its fixability cannot be said to be sufficient. In addition, after long-term printing, a density fluctuation may enlarge or fogging may occur in a white portion.

In addition, Japanese Patent Application Laid-Open No. 2013-33176 proposes a positively chargeable toner containing a polyester resin obtained by condensing a carboxylic acid component, which is selected from the group consisting of an adipic acid compound and a succinic acid compound substituted with an alkyl group or an alkenyl group, in the presence of a titanium catalyst. The toner described in Japanese Patent Application Laid-Open No. 2013-33176 has a high initial charge quantity, and is suppressed in initial fogging and development ghost. However, Japanese Patent Application Laid-Open No. 2013-33176 describes that when the resin is applied to a negatively chargeable toner, an improving effect on the initial charge quantity and an alleviating effect on the initial fogging are not obtained. In addition, when the toner is applied to high-speed printing, its low-temperature fixability is insufficient, or a density fluctuation or fogging after long-term printing increases in some cases.

SUMMARY OF THE INVENTION

An object of the present invention is to provide a toner that has solved the problems. Specifically, the object is to provide a toner and a two-component developer each of which: has low-temperature fixability and hot offset resistance corresponding to high-speed printing; and can suppress a fluctuation in image density and the fogging of a white portion after long-term printing.

According to one embodiment of the present invention, there is provided a toner, including:

- a binder resin;
- a colorant; and
- a wax,
- the toner being obtained through a step of melting and kneading the binder resin, the colorant, and the wax, in which:

- the binder resin includes:
  - a polyester resin A having polyhydric alcohol unit and polyvalent carboxylic acid unit, and
  - a polyester resin B having a polyhydric alcohol unit and a polyvalent carboxylic acid unit;
- a mass ratio (polyester resin A/polyester resin B) of the polyester resin A to the polyester resin B is from 10/90 or more to 60/40 or less;
- the polyester resin A has a softening point of from 120° C. or more to 180° C. or less;
- the polyester resin A contains 90 mol % or more of a polyhydric alcohol unit derived from an aromatic diol with respect to a total number of moles of the polyhydric alcohol unit, and contains 0.1 mol % or more to 10.0 mol % or less of a polyhydric alcohol unit derived from an oxyalkylene ether of a novolac type phenol resin with respect thereto;

the polyester resin A contains 15 mol % or more to 50 mol % or less of a polyvalent carboxylic acid unit derived from an aliphatic dicarboxylic acid, which contains a straight-chain hydrocarbon having 4 or more to 16 or less carbon atoms as a main chain and has carboxyl groups at both terminals of the main chain, with respect to a total number of moles of the polyvalent carboxylic acid unit;

the polyester resin B has a softening point of from 80° C. or more to 100° C. or less;

the polyester resin B contains 90 mol % or more of a polyhydric alcohol unit derived from an aromatic diol with respect to a total number of moles of the polyhydric alcohol unit; and the polyester resin B contains 90 mol % or more of a polyvalent carboxylic acid unit derived from one of an aromatic dicarboxylic acid and a derivative thereof with respect to a total number of moles of the polyvalent carboxylic acid unit.

Further, according to one embodiment of the present invention, there is provided a two-component developer including the toner and a magnetic carrier.

According to the present invention, it is possible to provide a toner and a two-component developer each of which: has low-temperature fixability and hot offset resistance corresponding to high-speed printing; and can suppress a fluctuation in image density and the fogging of a white portion after long-term printing.

Further features of the present invention will become apparent from the following description of exemplary embodiments with reference to the attached drawing.

BRIEF DESCRIPTION OF THE DRAWING

FIGURE is a view of a heat spheroidization treatment apparatus that can be used in the present invention.

DESCRIPTION OF THE EMBODIMENTS

Preferred Embodiments of the Present Invention will now be described in detail in accordance with the accompanying drawing.

A toner of the present invention is characterized in that: the toner contains, as a binder resin, a polyester resin A containing an aromatic diol as a main component and having a high softening point, and a polyester resin B containing an aromatic diol as a main component and having a low softening point; and the toner is obtained by melting and kneading the binder resin. In addition, the polyester resin A is characterized by having a polyhydric alcohol unit derived from an oxyalkylene ether of a novolac type phenol resin and a polyvalent carboxylic acid unit derived from an aliphatic dicarboxylic acid. In addition, the polyester resin B is characterized in that the main components of a polyhydric alcohol unit and a polyvalent carboxylic acid unit are each a diol or dicarboxylic acid having an aromatic ring. With such construction, the toner can have low-temperature fixability and hot offset resistance corresponding to high-speed printing, and suppress a fluctuation in image density and fogging after long-term printing.

The following procedure has heretofore been adopted: two polyester resins having different softening points are used as a binder resin, whereby the low-temperature fixability of a toner is improved by the polyester resin having the lower softening point and the hot offset resistance of the toner is improved by the polyester resin having the higher softening point. However, when long-term printing is performed with such toner, a fluctuation in image density or fogging may occur. The foregoing tendency is remarkable particularly in a normal-temperature and low-humidity environment or a high-temperature and high-humidity environment. The inventors of the present invention have considered a cause for the foregoing to be as described below. The polyester resin having the lower softening point is shaved off the surface of the toner by a stress in the long-term printing to change the chargeability of the toner. With the construction of each polyester resin like the present invention, the polyester resin having the lower softening point is hardly shaved off the toner even after the long-term printing, and hence the durable stability of the toner can be improved.

The inventors of the present invention have considered a mechanism for the foregoing to be as described below. The inventors have considered that it is because the mixing of the polyester resin having the lower softening point and the polyester resin having the higher softening point in the melting-kneading step for the toner is insufficient that the chargeability changes owing to the stress due to the long-term printing. It is assumed that when the mixing is insufficient, the polyester resin having the lower softening point is apt to be exposed to the surface of the toner upon production of the toner, and is hence apt to be shaved off by the stress due to the long-term printing. It is preferred that the polyester resin having the lower softening point and the polyester resin having the higher softening point be uniformly dispersed at the time of the melting and kneading in order that the polyester resin having the lower softening point may be hardly exposed to the surface of the toner.

In order that the polyester resins having different softening points may be uniformly dispersed by the melting and kneading, the inventors of the present invention have paid attention to two factors, i.e., compatibility and steric hindrance, and have made extensive studies. As a result, the inventors have found that when components derived from aromatic diols are used as the main components of the polyhydric alcohol unit of the polyester resin having the higher softening point and the polyester resin having the lower softening point, the compatibility therebetween improves. Further, the inventors have found that the steric hindrance at the time of the melting and kneading can be overcome by incorporating, into the polyester resin having the higher softening point, a unit derived from an oxyalkylene ether of a novolac type phenol resin and a unit derived from an aliphatic dicarboxylic acid. As a result, the inventors have found that the durable stability of the toner containing the polyester resins having different softening points improves, and thus have reached the present invention.

The toner of the present invention is characterized in that the toner is obtained by melting and kneading a binder resin, a colorant, and a wax. A polyester resin A and polyester resin B to be incorporated into the binder resin are mixed upon melting and kneading together with the colorant and the wax, whereby the polyester resin B is dispersed in the polyester resin A. Thus, a toner suppressed in density fluctuation and fogging after long-term printing is obtained.

In the toner of the present invention, the binder resin contains the polyester resin A and the polyester resin B. The sum of the contents of the polyester resin A and polyester resin B in 100 parts by mass of the binder resin is preferably 90 parts by mass or more.

Both the polyester resin A and the polyester resin B each have a polyhydric alcohol unit and a polyvalent carboxylic acid unit. The polyhydric alcohol unit in the present invention is a constituent derived from a polyhydric alcohol component used at the time of the condensation polymerization of a polyester. In addition, the polyvalent carboxylic acid unit in the present invention is a constituent derived from a polyvalent carboxylic acid used at the time of the condensation polymerization of the polyester, or an anhydride or lower alkyl ester thereof.

(Polyester Resin A)

(Softening Point)

The polyester resin A of the present invention is characterized in that its softening point is from 120° C. or more to 180° C. or less. When the softening point of the polyester resin A falls within the range, the hot offset resistance and low-temperature fixability of the toner are good. The softening point is preferably from 125° C. or more to 160° C. or less. When the softening point is less than 120° C., the hot offset resistance of the toner deteriorates, and when the softening point is more than 180° C., the low-temperature fixability of the toner deteriorates.

(Polyhydric Alcohol Unit)

Both the polyester resin A and polyester resin B of the present invention are each characterized in that the resin has a polyhydric alcohol unit and a polyvalent carboxylic acid unit, and contains 90 mol % or more of a polyhydric alcohol unit derived from an aromatic diol with respect to the total number of moles of the polyhydric alcohol unit. When the content of the polyhydric alcohol unit derived from the aromatic diol is less than 90 mol % with respect to the total number of moles of the polyhydric alcohol unit, the fogging of an image worsens. The polyhydric alcohol unit of the polyester resin A and the polyester resin B to be described later have a common structure derived from an aromatic diol. Accordingly, the resins are easily compatible with each other at the time of the melting and kneading, and hence the dispersibility of the polyester resin A and the polyester resin B after the melting and kneading improves.

Examples of the component derived from the aromatic diol include a bisphenol represented by the following chemical formula (1) and a derivative thereof.

(1)

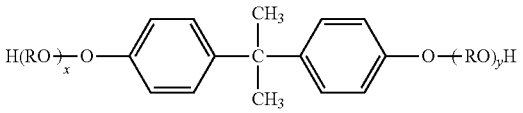

In the chemical formula (1), R represents an ethylene or propylene group, x and y each represent an integer of 0 or more, and the average of "x+y" is from 0 or more to 10 or less.

Above all, the polyester resin A and the polyester resin B are preferably identical to each other in R in the chemical formula (1) because the polyester resin A and the polyester resin B are easily compatible with each other at the time of the melting and kneading. Further, such a propylene oxide adduct of bisphenol A that both R's each represent a propylene group and the average of "x+y" is from 2 or more to 4 or less is preferred in terms of the charging stability of the toner.

In addition, the polyester resin A of the present invention is characterized by containing 0.1 mol % or more to 10.0 mol % or less of a polyhydric alcohol unit derived from an oxyalkylene ether of a novolac type phenol resin with respect to the total number of moles of the polyhydric alcohol unit.

The oxyalkylene ether of the novolac type phenol resin has an alcoholic hydroxyl value of 3 or more and reacts with an acid component to take a flexible crosslinked structure having a wide network. Accordingly, when the polyester resin B is mixed with the polyester resin A in the melting-kneading step for the toner, steric hindrance near a crosslinking point of the crosslinked structure of the polyester resin A is alleviated, and hence the polyester resin B is easily entangled. As a result, the polyester resin B is dispersed in the polyester resin A well and hence its exposure to the surface of the toner reduces. Accordingly, the toner becomes resistant to a stress after long-term printing. The oxyalkylene ether of the novolac type phenol resin is a reaction product of the novolac type phenol resin and a compound having one epoxy ring in a molecule thereof.

Examples of the novolac type phenol resin include the following: resins each produced by subjecting a phenol and an aldehyde to polycondensation while using an inorganic acid such as hydrochloric acid, phosphoric acid, or sulfuric acid, an organic acid such as p-toluenesulfonic acid or oxalic acid, or a metal salt such as zinc acetate as a catalyst as described in the section "Phenolic Resins" of "Encyclopedia of Polymer Science and Technology" (Interscience Publishers), Vol. 7, page 322.

Examples of the phenol include phenol and a substituted phenol having one or more hydrocarbon groups each having 1 or more to 35 or less carbon atoms, and/or halogen groups as substituents.

Specific examples of the substituted phenol include the following: cresol (ortho-cresol, meta-cresol, or para-cresol), ethylphenol, nonylphenol, octylphenol, phenylphenol, styrenated phenol, isopropenylphenol, 3-chlorophenol, 3-bromophenol, 3,5-xylenol, 2,4-xylenol, 2,6-xylenol, 3,5-dichlorophenol, 2,4-dichlorophenol, 3-chloro-5-methylphenol, dichloroxylenol, dibromoxylenol, 2,4,5-trichlorophenol, and 6-phenyl-2-chlorophenol. Two or more kinds of those phenols may be used in combination. Of those, phenol or a substituted phenol substituted with a hydrocarbon group is preferred. Of those, phenol, cresol, t-butylphenol, or nonylphenol is particularly preferred. Phenol and cresol are preferred because each of phenol and cresol is inexpensive and improves the offset resistance of the toner, and the substituted phenol substituted with a hydrocarbon group such as t-butylphenol or nonylphenol is preferred because the substituted phenol reduces the temperature dependence of the charge quantity of the toner.

Examples of the aldehyde include formalin (formaldehyde solutions having various concentrations), paraformaldehyde, trioxane, and hexamethylenetetramine. Although not particularly limited, the number-average molecular weight of the novolac type phenol resin is preferably from 300 or more to 8,000 or less, more preferably from 400 or more to 3,000 or less, still more preferably from 450 or more to 2,000 or less.

Although not particularly limited, the number-average nucleus number of the phenols in the novolac type phenol resin is preferably from 3 or more to 60 or less, more preferably from 3 or more to 20 or less, still more preferably from 4 or more to 15 or less. In addition, the softening point (JIS K2531: ring and ball method) of the novolac type phenol resin is, although not particularly limited, preferably from 40° C. or more to 180° C. or less, more preferably from 40° C. or more to 150° C. or less, still more preferably from 50° C. or more to 130° C. or less. The softening point is preferably 40° C. or more because blocking of the toner hardly occurs at normal temperature. In addition, the softening point is preferably 180° C. or less because the gelation is hardly caused in a production process for the polyester resin.

Specific examples of the compound having one epoxy ring in a molecule thereof include ethylene oxide (EO), 1,2-propylene oxide (PO), 1,2-butylene oxide, 2,3-butylene oxide, styrene oxide, and epichlorohydrin. In addition, an aliphatic monohydric alcohol having 1 or more to 20 or less carbon atoms and a glycidyl ether of a monohydric phenol can be used. Of those, EO or PO is preferred. Although not particularly limited, the addition number of moles of the compound having one epoxy ring in a molecule thereof with respect to 1 mol of the novolac type phenol resin is preferably from 1 mol or more to 30 mol or less, more preferably from 2 mol or more to 15 mol or less, still more preferably from 2.5 mol or more to 10 mol or less. In addition, the average addition number of moles of the compound having one epoxy ring in a molecule thereof with respect to one phenolic hydroxyl group in the novolac type phenol resin is, although not particularly limited, preferably from 0.1 mol or more to 10 mol or less, more preferably from 0.1 mol or more to 4 mol or less, still more preferably from 0.2 mol or more to 2 mol or less.

An example of the structure of the oxyalkylene ether of the novolac type phenol resin to be particularly preferably used in the present invention is given below.

(2)

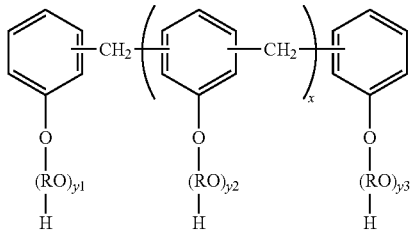

In the chemical formula (2), R's each represent an ethylene group or a propylene group, x represents a number of 0 or more, and y1 to y3 each independently represent a number of 0 or more.

Although not particularly limited, the number-average molecular weight of the oxyalkylene ether of the novolac type phenol resin is preferably from 300 or more to 10,000 or less, more preferably from 350 or more to 5,000 or less, still more preferably from 450 or more to 3,000 or less. The number-average molecular weight is preferably 300 or more because the hot offset resistance of the toner is good. In addition, the number-average molecular weight is preferably 10,000 or less because the gelation is hardly caused in the production process for the polyester resin A.

Although not particularly limited, the hydroxyl value (total of an alcoholic hydroxyl group and a phenolic hydroxyl group) of the oxyalkylene ether of the novolac type phenol resin is preferably from 10 mgKOH/g or more to 550 mgKOH/g or less, more preferably from 50 mgKOH/g or more to 500 mgKOH/g or less, still more preferably from 100 mgKOH/g or more to 450 mgKOH/g or less. In addition, a phenolic hydroxyl value out of the hydroxyl value is, although not particularly limited, preferably from 0 mgKOH/g or more to 500 mgKOH/g or less, more preferably from 0 mgKOH/g or more to 350 mgKOH/g or less, still more preferably from 5 mgKOH/g or more to 250 mgKOH/g or less.

The oxyalkylene ether of the novolac type phenol resin is obtained by, for example, subjecting the novolac type phenol resin and the compound having one epoxy ring in a molecule thereof to an addition reaction in the presence of a catalyst (a basic catalyst or an acid catalyst) as required. Although the temperature at which the reaction is performed is not particularly limited, the reaction temperature is preferably from 20° C. or more to 250° C. or less, more preferably from 70° C. or more to 200° C. or less, and the reaction can be performed under normal pressure, under pressure, or under reduced pressure. In addition, the reaction can be performed in the presence of a solvent (such as xylene or dimethylformamide), or any other dihydric alcohol and/or any other alcohol that is trihydric or more.

When the content of the polyhydric alcohol unit derived from the oxyalkylene ether of the novolac type phenol resin with respect to the total number of moles of the polyhydric alcohol unit in the polyester resin A is less than 0.1 mol %, the amount of the flexible crosslinked structure portion having a wide network reduces. Accordingly, the dispersibility of the polyester resin A and the polyester resin B does not improve, and suppressing effects on a density fluctuation and fogging after long-term printing are not obtained. On the other hand, when the content of the polyhydric alcohol unit is more than 10.0 mol %, the gel content of the polyester resin A becomes excessively large. Accordingly, the polyester resin A and the polyester resin B hardly mix at the time of the melting and kneading, and hence the suppressing effects on the density fluctuation and fogging after the long-term printing are also not obtained.

As a component for forming the polyhydric alcohol unit of the polyester resin A, in addition to the aromatic diol and the oxyalkylene ether of a novolac type phenol resin, the following polyhydric alcohol components may be used as required: ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbit, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethylbenzene.

(Polyvalent Carboxylic Acid Unit)

The polyester resin A of the present invention is characterized by containing 15 mol % or more to 50 mol % or less of a polyvalent carboxylic acid unit derived from an aliphatic dicarboxylic acid, which contains a straight-chain hydrocarbon having 4 or more to 16 or less carbon atoms as a main chain and has carboxyl groups at both terminals of the main chain, with respect to the total number of moles of the polyvalent carboxylic acid unit.

When the aliphatic dicarboxylic acid, which contains the straight-chain hydrocarbon having 4 or more to 16 or less carbon atoms as the main chain and has carboxyl groups at both terminals of the main chain, reacts with an alcohol component, the main chain of the polyester resin has a straight-chain hydrocarbon structure in itself and hence the structure of the main chain becomes partially flexible. Accordingly, in the melting-kneading step for the toner, the polyester resin B having the lower softening point to be described later is mixed with the polyester resin A having the higher softening point by using the flexible structure as a starting point, and hence the main chain of the polyester resin A and the polyester resin B are entangled with each other to improve the dispersibility.

Examples of the aliphatic dicarboxylic acid, which contains the straight-chain hydrocarbon having 4 or more to 16 or less carbon atoms as the main chain and has carboxyl groups at both terminals of the main chain, include alkyldicarboxylic acids such as adipic acid, azelaic acid, sebacic acid, tetradecanedioic acid, and ocatadecanedioic acid, anhydrides of these acids, and lower alkyl esters of these acids as well as compounds thereof each having a structure in which part of its main chain is branched with an alkyl group such as a methyl group, an ethyl group, or an octyl group or an alkylene group. The straight-chain hydrocarbon has preferably 4 or more to 12 or less carbon atoms, more preferably 4 or more to 10 or less carbon atoms.

When the aliphatic dicarboxylic acid to be used is an aliphatic dicarboxylic acid, which contains a straight-chain hydrocarbon having 3 or less carbon atoms as a main chain and has carboxyl groups at both terminals of the main chain, the effect by which the main chain of the polyester resin A is made flexible is hardly obtained, and hence a fluctuation in image density and fogging after long-term printing worsen. In addition, when an aliphatic dicarboxylic acid, which contains a straight-chain hydrocarbon having 17 or more carbon atoms as a main chain and has carboxyl groups at both terminals of the main chain, is used, the hot offset resistance of the toner reduces. In addition, when a dicarboxylic acid obtained by bonding a carboxyl group to a cyclohexane skeleton or a cyclohexene skeleton such as 1,4-cyclohexane dicarboxylic acid or cyclohexene-4,5-dicarboxylic acid is used, the effect by which the main chain of the polyester resin A is made flexible is hardly obtained, and hence suppressing effects on the fluctuation in image density and fogging after the long-term printing are not obtained.

When the content of the aliphatic carboxylic acid unit is less than 15 mol %, the amount of a partially flexible structure portion in the main chain of the polyester resin A reduces. Accordingly, its dispersibility with the polyester resin B deteriorates, and hence a fluctuation in image density and fogging after long-term printing worsen. On the other hand, when the content of the aliphatic carboxylic acid unit is more than 50 mol %, the main chain of the polyester resin A becomes excessively flexible, and hence the molecules of the polyester resin A are entangled with each other and the resin hardly mixes with the polyester resin B instead. Accordingly, suppressing effects on the fluctuation in image density and fogging after the long-term printing are not obtained.

As the other polyhydric carboxylic acid unit to be incorporated into the polyester resin A, there are given, for example: aromatic dicarboxylic acid such as phthalic acid, isophthalic acid, and terephthalic acid or anhydrides thereof; a succinic acid substituted with an alkyl group or alkenyl group having 6 or more to 18 or less carbon atoms or anhydrides thereof; and unsaturated dicarboxylic acids such as fumaric acid, maleic acid, and citraconic acid or anhydrides thereof. Of those units, carboxylic acids each having an aromatic ring or derivatives thereof such as terephthalic acid, isophthalic acid, trimellitic acid, pyromellitic acid, benzophenonetetracarboxylic acid, and anhydrides thereof are preferably used because the hot offset resistance of the toner can easily be improved.

(Polyester Resin B)

The polyester resin B of the present invention contains a polyhydric alcohol unit and a polyvalent carboxylic acid unit.

(Softening Point)

The polyester resin B of the present invention is characterized in that its softening point is from 80° C. or more to 100° C. or less. When the softening point of the polyester resin B falls within the range, the storage stability and low-temperature fixability of the toner are good. The softening point is preferably from 85° C. or more to 100° C. or less. When the softening point is less than 80° C., the storage stability of the toner deteriorates, and when the softening point is more than 100° C., the low-temperature fixability of the toner deteriorates.

(Polyhydric Alcohol Unit)

The polyester resin B is characterized by containing 90 mol % or more of a polyhydric alcohol unit derived from an aromatic diol with respect to the total number of moles of the polyhydric alcohol unit. When the content of the polyhydric alcohol unit derived from the aromatic diol is less than 90 mol % with respect to the total number of moles of the polyhydric alcohol unit, fogging worsens. The value is preferably 95 mol % or more, more preferably 100 mol % in order that compatibility between the polyester resin A and the polyester resin B may be secured.

As a component for forming the polyhydric alcohol unit of the polyester resin B other than the aromatic diol, the following polyhydric alcohol components may be used: ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropyleneglycol, polyethylene glycol, polypropylene glycol, polytetramethylene glycol, sorbit, 1,2,3,6-hexanetetrol, 1,4-sorbitan, pentaerythritol, dipentaerythritol, tripentaerythritol, 1,2,4-butanetriol, 1,2,5-pentanetriol, glycerin, 2-methylpropanetriol, 2-methyl-1,2,4-butanetriol, trimethylolethane, trimethylolpropane, and 1,3,5-trihydroxymethyl benzene.

(Polyvalent Carboxylic Acid Unit)

The polyester resin B of the present invention is characterized by containing 90 mol % or more of a polyvalent carboxylic acid unit derived from an aromatic dicarboxylic acid or a derivative thereof with respect to the total number of moles of the polyvalent carboxylic acid unit. When the content of the polyvalent carboxylic acid unit derived from an aromatic dicarboxylic acid or a derivative thereof falls within the range, compatibility between the polyester resin B and the polyester resin A is improved, and thus, a fluctuation in image density and fogging after long-term printing can be suppressed. Examples of the aromatic dicarboxylic acid or a derivative thereof include aromatic dicarboxylic acids such as phthalic acid, isophthalic acid, and terephthalic acid or anhydrides thereof.

In addition, the polyester resin B preferably contains 0.1 mol % or more to 10.0 mol % or less of a polyvalent carboxylic acid unit derived from an aliphatic dicarboxylic acid or a derivative thereof with respect to the total number of moles of the polyvalent carboxylic acid unit because the low-temperature fixability of the toner is further improved. Examples of the aliphatic dicarboxylic acid or a derivative thereof include: alkyldicarboxylic acids such as succinic acid, adipic acid, sebacic acid, and azelaic acid or anhydrides thereof; succinic acid substituted with an alkyl group or alkenyl group having 6 or more to 18 or less carbon atoms or anhydrides thereof; and unsaturated dicarboxylic acids such as fumaric acid, maleic acid, and citraconic acid or anhydrides thereof. Of those, succinic acid, adipic acid, fumaric acid and acid anhydrides thereof, and a lower alkyl ester are preferably used. An example of the polyvalent carboxylic acid unit other than those units is a trivalent or tetravalent carboxylic acid such as trimellitic acid, pyromellitic acid, benzophenonetetracarboxylic acid, or anhydrides thereof.

In addition, the acid value of the polyester resin B of the present invention is preferably from 0 mgKOH/g or more to 30 mgKOH/g or less because a change in charge quantity of the toner due to an environment is small, and the acid value is more preferably from 0 mgKOH/g or more to 20 mgKOH/g or less.

(Ratio of Resin a to Resin B)

In the present invention, a mass ratio A/B of the polyester resin A to the polyester resin B is characterized by being from 10/90 or more to 60/40 or less. The mass ratio A/B is preferably from 20/80 or more to 40/60 or less. When the mass ratio A/B falls within the range, the low-temperature fixability of the toner is good, and hence a fluctuation in image density and fogging after long-term printing are suppressed. When the mass ratio A/B is less than 10/90, the hot offset resistance of the toner reduces or the content of the polyester resin A is so small that the polyester resin B is hardly dispersed, and the fluctuation in image density and fogging after the long-term printing worsen. When the mass ratio A/B is more than 60/40, the low-temperature fixability of the toner deteriorates.

(Glass Transition Temperature)

In addition, a glass transition temperature Tg(80) and glass transition temperature Tg(180) of the polyester resin A measured with a differential scanning calorimeter (DSC) preferably have a relationship represented by the following mathematical expression (1). It should be noted that the Tg(80) is a glass transition temperature measured by increasing the temperature of the resin to 80° C. once, then reducing the temperature to 30° C., and then increasing the temperature again. In addition, the Tg(180) is a glass transition temperature measured by increasing the temperature of the resin to 180° C. once, then reducing the temperature to 30° C., and then increasing the temperature again. Methods of measuring the Tg(80) and the Tg(180) are described in detail in the section "Examples".

$$-1.0 \leq Tg(80) - Tg(180) \leq 1.0 \quad (1)$$

When the polyester resin A satisfies the relationship, the entanglement of the polymer chains of the polyester resin A may be easily loosened, and hence the polyester resin A easily mixes well with the polyester resin B at the time of the melting and kneading. As a result, a fluctuation in image density and fogging after long-term printing are additionally suppressed.

In general, the glass transition point of even one and the same resin is affected by the extent to which its polymer chains are entangled with each other. The resin tends to show a higher glass transition point as the extent of entanglement enlarges. The Tg(80) is a glass transition temperature measured after the temperature of the polyester resin A has been increased to a temperature lower than the softening point of the resin by 40° C. or more and then reduced. On the other hand, the Tg(180) is a glass transition temperature measured after the temperature of the polyester resin A has been increased to a temperature equal to or higher than the softening point of the resin to accelerate the motion of its polymer chains, and then has been reduced. Therefore, the Tg(80) of a resin whose polymer chains are easily entangled with each other and hardly loosened shows a larger value than that of its Tg(180) because an influence of the entanglement cannot be completely cancelled merely by increasing its temperature to 80° C. On the other hand, the Tg(80) of a resin whose polymer chains are easily loosened shows a value substantially equal to that of its Tg(180) because the extent to which its molecular chains are entangled with each other can be reduced merely by increasing its temperature to 80° C., and a difference between both the temperatures falls within the range of ±1.0° C. As described above, the difference between the Tg(80) and the Tg(180) originates from the crosslinked structure of the resin. The difference is caused even by a raw material constituting the polyester resin, and even when the same raw material is used, the difference is caused even by a reaction temperature, degree of vacuum, and the like in a polycondensation reaction.

It should be noted that in the case of the polyester resin B, its Tg(80) and Tg(180) show substantially the same value irrespective of a raw material and a polycondensation condition because the resin does not have a very large amount of a crosslinked structure and has a low softening point, and a difference therebetween falls within the range of ±1.0° C.

(Wax)

Examples of the wax used for the toner of the present invention include the following: hydrocarbon-based waxes such as a low molecular weight polyethylene, a low molecular weight polypropylene, an alkylene copolymer, a microcrystalline wax, a paraffin wax, and a Fischer-Tropsch wax; oxides of hydrocarbon-based waxes such as an oxidized polyethylene wax or block copolymers thereof; waxes containing a fatty acid ester as a main component such as a carnauba wax; waxes obtained by partially or totally deoxidizing fatty acid esters such as a deoxidized carnauba wax, and further include the following: saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of fatty acids such as palmitic acid, stearic acid, behenic acid, and montanic acid and alcohols such as stearyl alcohol, aralkyl alcohol, behenyl alcohol, carnaubyl alcohol, ceryl alcohol, and melissyl alcohol; fatty acid amides such as linoleic acid amide, oleic acid amide, and lauric acid amide; saturated fatty acid bisamides such as methylenebisstearic acid amide, ethylenebiscapric acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebacic acid amide; aromatic bisamides such as m-xylenebisstearic acid amide and N,N'-distearylisophthalic acid amide; aliphatic metal salts (generally called a metal soap) such as calcium stearate, calcium laurate, zinc stearate, and magnesium stearate; waxes obtained by grafting vinyl-based monomers such as styrene and acrylic acid into aliphatic hydrocarbon-based waxes; partial esters of fatty acids such as behenic acid monoglyceride and polyhydric alcohols; and methyl ester compounds having a hydroxyl group obtained by hydrogenation of a vegetable oil and fat.

Of those waxes, hydrocarbon-based waxes such as a paraffin wax and a Fischer-Tropsch wax or fatty acid ester-based waxes such as a carnauba wax are preferred in terms of improving the low-temperature fixability and hot offset resistance of the toner. In the present invention, hydrocarbon-based waxes are more preferred in terms of additionally improving the hot offset resistance of the toner.

In the present invention, the waxes are preferably used in an amount of from 1 part by mass or more to 20 parts by mass or less with respect to 100 parts by mass of the binder resin.

In addition, the peak temperature of the highest endothermic peak of the wax in an endothermic curve at the time of temperature increase measured with a differential scanning calorimeter (DSC) is preferably from 45° C. or more to 140° C. or less. It is because compatibility between the storage stability and hot offset resistance of the toner can be achieved that the peak temperature of the highest endothermic peak of the wax preferably falls within the range.

(Polymer C)

The binder resin of the toner of the present invention preferably contain a polymer C having a structure in which a vinyl-based resin component and a hydrocarbon compound are bonded to each other. The polymer C is preferably a polymer in which a polyolefin is bonded to the vinyl-based resin component or a polymer having the vinyl-based resin component obtained by bonding a vinyl-based monomer to the polyolefin. The polymer C may improve an affinity between the polyester resin A or the polyester resin B and the wax in the toner. Accordingly, excessive exudation of the wax to the surface of the toner can be suppressed, and hence a fluctuation in image density and fogging are additionally suppressed. This is why the polymer C is preferably incorporated. The foregoing effect becomes significant particularly when the polymer is combined with a hydrocarbon-based wax.

The content of the polymer C is preferably from 2 parts by mass or more to 10 parts by mass or less, more preferably from 3 parts by mass or more to 8 parts by mass or less in 100 parts by mass of the binder resin. When the content of the polymer C falls within the range, the durable stability of the toner can be additionally improved while its low-temperature fixability is maintained.

The polyolefin in the polymer C is not particularly limited as long as the polyolefin is a polymer or copolymer of an unsaturated hydrocarbon-based monomer having one double bond, and various polyolefins can each be used. A polyethylene- or polypropylene-based polyolefin is particularly preferably used as the polyolefin.

Examples of the vinyl-based monomer used for the vinyl-based resin component in the polymer C include:

styrene-based monomers such as styrene and derivatives thereof such as styrene, o-methyl styrene, m-methyl styrene, p-methyl styrene, p-methoxy styrene, p-phenyl styrene, p-chloro styrene, 3,4-dichloro styrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, and p-n-dodecyl styrene;

amino group-containing a-methylene aliphatic monocarboxylic acid esters such as dimethylaminoethyl methacrylate and diethylaminoethyl methacrylate; and N atom-containing vinyl-based monomers such as acrylic or methacrylic derivatives such as acrylonitrile, methacrylonitrile, and acrylamide;

unsaturated dibasic acids such as maleic acid, citraconic acid, itaconic acid, alkenyl succinic acid, fumaric acid, and mesaconic acid; unsaturated dibasic acid anhydrides such as a maleic acid anhydride, a citraconic acid anhydride, an itaconic acid anhydride, and an alkenyl succinic acid anhydride; half esters of unsaturated dibasic acids such as a methyl maleate half ester, an ethyl maleate half ester, a butyl maleate half ester, a methyl citraconate half ester, an ethyl citraconate half ester, a butyl citraconate half ester, a methyl itaconate half ester, a methyl alkenyl succinate half ester, a methyl fumarate half ester, and a methyl mesaconate half ester; esters of unsaturated dibasic acids such as dimethyl maleate and dimethyl fumarate; α,β-unsaturated acids such as acrylic acid, methacrylic acid, crotonic acid, and cinnamic acid; α,β-unsaturated acid anhydrides such as a crotonic anhydride and a cinnamic anhydride and anhydrides of the α,β-unsaturated acids and lower fatty acids; and carboxyl group-containing vinyl-based monomers such as alkenyl malonic acid, alkenyl glutaric acid, alkenyl adipic acid, and an anhydride and monoester of these acids;

acrylic or methacrylic acid esters such as 2-hydroxyethyl acrylate, 2-hydroxyethyl methacrylate, and 2-hydroxypropyl methacrylate; and hydroxyl group-containing vinyl-based monomers such as 4-(1-hydroxy-1-methylbutyl)styrene and 4-(1-hydroxy-1-methylhexyl)styrene;

acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and methacrylic acid esters such as a-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

Preferably, the vinyl-based resin component in the polymer C contains a styrene-based unit, an ester-based unit, an acrylonitrile unit, or a methacrylonitrile unit as a constituent unit.

The polymer C having a structure in which the vinyl-based resin component and the hydrocarbon compound are bonded to each other to be used in the present invention can be obtained by a known method such as a reaction between such vinyl-based monomers as described in the foregoing or a reaction between a monomer for one polymer and the other polymer.

In addition to the polyester resin A, the polyester resin B, and the polymer C, the following "other resin" can be added as a binder resin to be used in the toner of the present invention for the purposes of improving pigment dispersibility, and improving the charging stability and blocking resistance of the toner in such an amount as not to inhibit any effect of the present invention.

(Other Resin)

Examples of the "other resin" include the following resins: monopolymers of styrene or a substitute thereof such as polystyrene, poly-p-chlorostyrene, and polyvinyl toluene; styrene-based copolymers such as a styrene-p-chlorostyrene copolymer, a styrene-vinyltoluene copolymer, a styrene-vinyl naphthaline copolymer, a styrene-acrylate copolymer, a styrene-methacrylate copolymer, a styrene-α-methyl chloromethacrylate copolymer, a styrene-acrylonitrile copolymer, a styrene-vinyl methyl ether copolymer, a styrene-vinyl ethyl ether copolymer, a styrene-vinyl methyl ketone copolymer, and a styrene-acrylonitrile-indene copolymer; and polyvinyl chloride, a phenolic resin, a natural modified phenolic resin, a natural resin-modified maleic resin, an acrylic resin, a methacrylic resin, polyvinyl acetate, a silicone resin, a polyester resin, polyurethane, a polyamide resin, a furan resin, an epoxy resin, a xylene resin, polyvinyl butyral, a terpene resin, a coumarone-indene resin, and a petroleum-based resin.

(Colorant)

Examples of the colorant to be incorporated into each toner particle of the toner of the present invention include the following colorants.

A black colorant is, for example, carbon black or a colorant toned to a black color with a yellow colorant, a magenta colorant, and a cyan colorant. Although one kind of pigment may be used alone as the colorant, a dye and a pigment are preferably used in combination to improve the color definition in terms of the image quality of a full-color image.

As a pigment for a magenta toner, there are given, for example: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, or 282; C.I. Pigment Violet 19; and C.I. Vat Red 1, 2, 10, 13, 15, 23, 29, or 35.

As a dye for a magenta toner, there are given, for example: oil-soluble dyes such as: C.I. Solvent Red 1, 3, 8, 23, 24, 25, 27, 30, 49, 81, 82, 83, 84, 100, 109, or 121; C.I. Disperse Red 9; C.I. Solvent Violet 8, 13, 14, 21, or 27; and C.I. Disperse Violet 1; and basic dyes such as: C.I. Basic Red 1, 2, 9, 12, 13, 14, 15, 17, 18, 22, 23, 24, 27, 29, 32, 34, 35, 36, 37, 38, 39, or 40; and C.I. Basic Violet 1, 3, 7, 10, 14, 15, 21, 25, 26, 27, or 28.

As a pigment for a cyan toner, there are given, for example: C.I. Pigment Blue 2, 3, 15:2, 15:3, 15:4, 16, or 17; C.I. Vat Blue 6; C.I. Acid Blue 45; and a copper phthalocyanine pigment in which a phthalocyanine skeleton is substituted with 1 or more to 5 or less phthalimidomethyl groups.

C.I. Solvent Blue 70 is given as a dye for a cyan toner.

As a pigment for a yellow toner, there are given, for example: C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, or 185; and C.I. Vat Yellow 1, 3, or 20.

C.I. Solvent Yellow 162 is given as a dye for yellow toner.

The colorant is preferably used in an amount of from 0.1 part by mass or more to 30 parts by mass or less with respect to 100 parts by mass of the binder resin.

(Additive)

A charge control agent may be incorporated into the toner of the present invention as required. Although a known charge control agent can be utilized as the charge control agent to be incorporated into the toner, a metal compound of an aromatic carboxylic acid that is colorless, increases the speed at which the toner is charged, and can stably hold a constant charge quantity is particularly preferred.

As a negative charge control agent, the following are given: a metal salicylate compound, a metal naphthoate compound, a metal dicarboxylate compound, a polymeric compound having a sulfonic acid or a carboxylic acid in a side chain, a polymeric compound having a sulfonic acid salt or a sulfonic acid ester in a side chain, a polymeric compound having a carboxylic acid salt or a carboxylic acid ester in a side chain, a boron compound, a urea compound, a silicon compound, and a calixarene. As a positive charge control agent, the following are given: a quaternary ammonium salt, a polymeric compound having a quaternary ammonium salt in a side chain, a guanidine compound, and an imidazole compound. The charge control agent may be internally added to each toner particle or may be externally added to the toner particle. The charge control agent is preferably added in an amount of from 0.2 part by mass or more to 10 parts by mass or less with respect to 100 parts by mass of the binder resin.

Inorganic fine particles can also be incorporated into the toner of the present invention as required. The inorganic fine particles may be internally added to the particles of the toner or may be mixed as an external additive with the toner particles. The external additive is preferably inorganic fine particles (inorganic fine powder) made of silica, titanium oxide, aluminum oxide, or the like. The inorganic fine particles are preferably hydrophobized with a hydrophobizing agent such as a silane compound, a silicone oil, or a mixture thereof.

An external additive for improving the flowability of the toner is preferably inorganic fine particles having a specific surface area of from 50 $m^2/g$ or more to 400 $m^2/g$ or less, and an external additive for stabilizing the durability of the toner is preferably inorganic fine particles having a specific surface area of from 10 $m^2/g$ or more to 50 $m^2/g$ or less. A plurality of kinds of inorganic fine particles whose specific surface areas fall within the ranges may be used in combination in order that compatibility between the improvement in the flowability of the toner and the stabilization of its durability may be achieved.

The external additive is preferably used in an amount of from 0.1 part by mass or more to 10.0 parts by mass or less with respect to 100 parts by mass of the toner particles. A known mixer such as a Henschel mixer can be used in the mixing of the toner particles and the external additive.

(Two-Component Developer)

The toner of the present invention can be used as a one-component system developer. The toner is preferably mixed with a magnetic carrier and used as a two-component developer in order that its dot reproducibility may be additionally improved and a stable image may be obtained over a long time period.

(Magnetic Carrier)

Examples of the magnetic carrier include the following: an iron powder whose surface has been oxidized; an unoxidized iron powder; particles of metals such as iron, lithium, calcium, magnesium, nickel, copper, zinc, cobalt, manganese, chromium, and rare earths; particles of alloys thereof; magnetic materials such as oxide particles and ferrite; and a magnetic material-dispersed resin carrier (the so-called resin carrier) containing a magnetic material and a binder resin holding the magnetic material in a state where the magnetic material is dispersed therein.

When the toner of the present invention is mixed with the magnetic carrier and used as a two-component developer, the concentration of the toner in the two-component developer is preferably from 2 mass % or more to 15 mass % or less, more preferably from 4 mass % or more to 13 mass % or less.

(Method of Producing Toner)

A method of producing the toner particles is preferably a pulverization method involving melting and kneading the binder resin, the colorant, and the wax, cooling the kneaded product, and pulverizing and classifying the cooled product because the binder resin, the colorant, and the wax need to be melted and kneaded.

Hereinafter, an example of a procedure for the production of the toner by the pulverization method is described.

In a raw material-mixing step, predetermined amounts of materials for forming the toner particles, e.g., a binder resin, a wax, a colorant, and other component such as a charge control agent to be used as required are weighed, blended, and mixed. As a mixing apparatus, there are given, for example, a double cone mixer, a V-type mixer, a drum-type mixer, a super mixer, a Henschel mixer, a Nauta mixer, and MECHANO HYBRID (manufactured by NIPPON COKE & ENGINEERING CO., LTD.).

Next, the mixed materials are melted and kneaded to disperse the wax and the like in the binder resin. In the melting-kneading step, a batch kneader such as a pressurizing kneader or a Banbury mixer, or a continuous kneader can be used. A single-screw or a twin-screw extruder is a mainstream because of the advantage of continuous production. Examples thereof include: a twin-screw extruder model KTK (manufactured by Kobe Steel., Ltd.); a twin-screw extruder model TEM (manufactured by Toshiba Machine CO., Ltd.); a PCM kneader (manufactured by Ikegai Corp.); a twin-screw extruder (manufactured by KCK CO., Ltd.); a co-kneader (manufactured by Buss Inc.); and KNEADEX (NIPPON COKE & ENGINEERING CO., LTD.). Further, a resin composition obtained by melting and kneading may be rolled by a twin roll or the like, and cooled with water or the like in a cooling step.

Next, a cooled product of the resin composition is pulverized to a desired particle diameter in a pulverizing step. In the pulverizing step, the cooled product is coarsely pulverized with a pulverizer such as a crusher, a hammer mill, or a feather mill, and is then finely pulverized with, for example, Kryptron System (manufactured by Kawasaki Heavy Industries, Ltd.), Super Rotor (manufactured by Nisshin Engineering Inc.), Turbo Mill (manufactured by FREUND-TURBO CORPORATION), or a fine pulverizer based on an air-jet system.

After that, as required, the resultant particles are classified with an inertial classification type classifier or sieving machine such as Elbow-Jet (manufactured by NITTETSU MINING CO., LTD), or a centrifugal type classifier or sieving machine such as Turboplex (manufactured by Hosokawa Micron Corporation), TSP Separator (manufactured by Hosokawa Micron Corporation), or Faculty (manufactured by Hosokawa Micron Corporation) to obtain a classified product (toner particles). Of those, Faculty (manufactured by Hosokawa Micron Corporation) can perform spheroidization treatment for the toner particles as well as classification and is preferred from the viewpoint of transfer efficiency.

In addition, after the pulverization, the surface treatment of the toner particles such as spheroidization treatment may be performed with Hybridization System (manufactured by NARA MACHINERY CO., LTD.), Mechanofusion System (manufactured by Hosokawa Micron Corporation), Faculty (manufactured by Hosokawa Micron Corporation), or Meteorainbow MR Type (manufactured by Nippon Pneumatic Mfg. Co., Ltd.) as required.

The treatment of the surfaces of the toner particles with heat is particularly preferred because the circularity of the toner can be easily increased and its transfer efficiency improves. In addition, the treatment is preferred because of the following reason: the wax is distributed in a large amount near the surfaces of the toner particles by the heating, and hence the wax exhibits its releasing effect in an additionally quick manner in a toner-fixing step and the hot offset resistance of the toner additionally improves. For example, the surfaces can be treated with hot air by using a heat spheroidization treatment apparatus illustrated in FIGURE.

In FIGURE, a mixture supplied in a constant amount by a raw material constant amount-supplying unit 1 is introduced into an introducing tube 3 placed on the central axis of a treatment chamber 6 by a compressed gas adjusted by a compressed gas-adjusting unit 2. The mixture that has passed the introducing tube is uniformly dispersed by a conical protruding member 4 provided in the central portion of a raw material-supplying unit, introduced into supplying tubes 5 radially extending in 8 directions, and introduced from a powder particle-supplying port 14 into the treatment chamber 6 where the mixture is thermally treated.

At this time, the flow of the mixture supplied to the treatment chamber is regulated by a regulating unit 9 for regulating the flow of a mixture, the unit being provided in the treatment chamber. Accordingly, the mixture supplied to the treatment chamber is thermally treated while swirling in the treatment chamber, and is then cooled.

Hot air for thermally treating the supplied mixture is supplied from a hot air inlet portion 7 of a hot air-supplying unit, and the hot air is introduced into the treatment chamber while being spirally swirled by a swirling member 13 for swirling the hot air. With regard to its construction, the swirling member 13 for swirling the hot air has a plurality of blades, and can control the swirl of the hot air depending on the number and angles of the blades. At this time, the bias of the hot air to be swirled can be reduced by a substantially conical distributing member 12. The temperature of the hot air to be supplied into the treatment chamber at a hot air outlet portion 11 of the hot air-supplying unit is preferably from 100° C. to 300° C. It is because of the following reason that the temperature at the outlet portion of the hot air-supplying unit preferably falls within the range: the toner particles can be uniformly subjected to a spheroidization treatment while the fusion and coalescence of the toner particles due to excessive heating of the mixture are prevented, and the hot offset resistance improves.

Further, the thermally treated toner particles are cooled by cold air supplied from cold air-supplying units 8 (8-1, 8-2, and 8-3), and the temperature of the cold air supplied from the cold air-supplying units 8 is preferably from −20° C. to 30° C. When the temperature of the cold air falls within the range, the thermally treated toner particles can be efficiently cooled, and the fusion and coalescence of the thermally treated toner particles can be prevented without the inhibition of the uniform spheroidization treatment of the mixture. The absolute moisture content of the cold air is preferably from 0.5 g/m$^3$ or more to 15.0 g/m$^3$ or less. Next, the thermally treated toner particles that have been cooled are recovered by a recovering unit 10 placed at the lower end of the treatment chamber. It should be noted that the recovering unit is constituted as follows: its tip is provided with a blower (not shown), and the particles are sucked and conveyed by the blower.

In addition, the powder particle-supplying port is provided so that the swirling direction of the supplied mixture and the swirling direction of the hot air may be identical to each other, and the recovering unit is provided in the outer peripheral portion of the treatment chamber so as to maintain the swirling direction of the swirled powder particles. Further, the cold air supplied from the cold air-supplying units 8 is constituted so as to be supplied from the outer peripheral portion of the apparatus into the inner peripheral surface of the treatment chamber from a horizontal and tangential direction. The swirling direction of the toner supplied from the powder particle-supplying port, the swirling direction of the cold air supplied from the cold air-supplying unit, and the swirling direction of the hot air supplied from the hot air-supplying unit are identical to one another. Accordingly, no turbulence occurs in the treatment chamber, a swirl flow in the apparatus is strengthened, a strong centrifugal force is applied to the toner, and the dispersibility of the toner additionally improves, and hence a toner having a small amount of a coalesced particle and a uniform shape can be obtained.

The average circularity of the toner is preferably from 0.930 or more to 0.985 or less. In addition, when the toner particles are subjected to a surface treatment such as a spheroidization treatment or to a surface treatment by a heat treatment, the average circularity is preferably from 0.955 or more to 0.980 or less because compatibility between an improvement in transferability and cleaning property can be achieved.

Further, the surfaces of the toner particles are subjected to an external addition treatment with an external additive as required. A method for the external addition treatment with the external additive is, for example, a method involving blending predetermined amounts of a classified toner and various known external additives, and stirring and mixing the contents through the use of a mixing apparatus such as a double cone mixer, a V-type mixer, a drum-type mixer, a super mixer, a Henschel mixer, a Nauta mixer, MECHANO HYBRID (manufactured by NIPPON COKE & ENGINEERING CO., LTD.), or NOBILTA (manufactured by Hosokawa Micron Corporation) as an external addition machine.

In addition, the external addition treatment with the external additive can be performed before a surface treatment by a heat treatment. This case is preferred because of the following reason. The external additive is stuck to the surfaces of the toner particles by the heat treatment and hence the surfaces of the toner particles are hardly shaved even by a stress due to long-term printing. Accordingly, even in a normal-temperature and low-humidity environment or a high-temperature and high-humidity environment, a density fluctuation after the long-term printing is suppressed and fogging after the printing is alleviated.

Hereinafter, the present invention is described by way of examples and the like. Prior to the examples, methods of measuring the various physical properties of the toner and raw materials therefor, and production examples of its binder resin (the polyester resin A, the polyester resin B, and the polymer C) are described.

(Method of Measurement)

<1. Measurement of Softening Point of Resin>

The softening point of the resin is measured through use of a constant-pressure extrusion system capillary rheometer "flow characteristic-evaluating apparatus Flow Tester CFT-500D" (manufactured by Shimadzu Corporation) in accordance with the manual attached to the apparatus. In this apparatus, a measurement sample filled in a cylinder is increased in temperature to be melted while a predetermined load is applied to the measurement sample with a piston from above, and the melted measurement sample is extruded from a die in a bottom part of the cylinder. At this time, a flow curve representing a relationship between a piston descent amount and the temperature is obtained.

In the present invention, a "melting temperature in a ½ method" described in the manual attached to the apparatus is defined as a softening point. It should be noted that the melting temperature in the ½ method is calculated as described below. First, ½ of a difference between a descent amount Smax of the piston at a time when the outflow is finished and a descent amount Smin of the piston at a time when the outflow is started is determined (The ½ of the difference is defined as X. X=(Smax-Smin)/2). Then, the temperature in the flow curve when the descent amount of the piston reaches "Smin+X" in the flow curve is the melting temperature in the ½ method.

The measurement sample is obtained by subjecting about 1.0 g of the resin to compression molding for about seconds under about 10 MPa through use of a tablet compressing machine (for example, NT-100H, manufactured by NPa SYSTEM Co., Ltd.) under an environment of 25° C. to form the resin into a cylindrical shape having a diameter of about 8 mm.

The measurement conditions of the CFT-500D are as described below.

Test mode: heating method
Starting temperature: 50° C.
Reached temperature: 200° C.
Measurement interval: 1.0° C.
Rate of temperature increase: 4.0° C./min
Piston sectional area: 1.000 $cm^2$
Test load (piston load): 10.0 kgf (0.9807 MPa)
Preheating time: 300 seconds
Diameter of hole of die: 1.0 mm
Length of die: 1.0 mm <2. Measurement of Glass Transition Temperature (Tg (80), TG(180)) of Resin>

The glass transition temperature of the resin is measured with a differential scanning calorimeter "Q1000" (manufactured by TA Instruments) in conformity with ASTM D3418-82. The melting points of indium and zinc are used for the temperature correction of the detecting portion of the apparatus, and the heat of fusion of indium is used for the correction of a heat quantity.

Specifically, about 5 mg of the resin are precisely weighed and loaded into a pan made of aluminum, and then measurement is performed by using an empty pan made of aluminum as a reference in the measuring range of from 30 to 200° C. at a rate of temperature increase of 10° C./min. It should be noted that in the measurement of Tg(80), the temperature of the resin is increased to 80° C. once and held at the temperature for 10 minutes. Subsequently, the temperature is reduced to 30° C. and then increased again. In the second temperature increase process, a change in specific heat is obtained in the temperature range of from 30 to 100° C. The point of intersection of a line, which connects the midpoints of baselines before and after the appearance of the change in specific heat, and a differential thermal curve at this time is defined as the glass transition temperature (Tg(80)) of the resin. In addition, in the measurement of the Tg(180), the temperature of the resin is increased to 180° C. once and held at the temperature for 10 minutes, is subsequently reduced to 30° C., and is then increased again. In the second temperature increase process, a change in specific heat is obtained in the temperature range of from 30 to 100° C. The point of intersection of a line, which connects the midpoints of baselines before and after the appearance of the change in specific heat, and a differential thermal curve at this time is defined as the glass transition temperature (Tg(180)) of the resin.

<3. Measurement of Highest Endothermic Peak of Wax>

The peak temperature of the highest endothermic peak of the wax is measured with a differential scanning calorimeter "Q1000" (manufactured by TA Instruments) in conformity with ASTM D3418-82. The melting points of indium and zinc are used for the temperature correction of the detecting portion of the apparatus, and the heat of fusion of indium is used for the correction of a heat quantity.

Specifically, about 10 mg of the wax are precisely weighed and loaded into a pan made of aluminum, and then measurement is performed by using an empty pan made of aluminum as a reference in the measurement temperature range of from 30° C. or more to 200° C. or less at a rate of temperature increase of 10° C./min. It should be noted that in the measurement, the temperature of the wax is increased to 200° C. once, is subsequently reduced to 30° C., and is then increased again. The temperature at which the DSC curve shows the highest endothermic peak in the temperature range of from 30° C. or more to 200° C. or less in the second temperature increase process is defined as the peak temperature of the highest endothermic peak of the wax.

<4. Measurement of BET Specific Surface Area of Inorganic Fine Particles>

The BET specific surface area of inorganic fine particles is measured in conformity with JIS 28830 (2001). A specific measurement method is as described below.

Used as a measuring apparatus is an "automatic specific surface area/pore distribution-measuring apparatus TriStar 3000 (manufactured by Shimadzu Corporation)" adopting a gas adsorption method based on a constant volume method as a measurement system. The setting of a measurement condition and the analysis of measured data are performed with the dedicated software "TriStar 3000 Version 4.00" included with the apparatus. A vacuum pump, a nitrogen gas piping, and a helium gas piping are connected to the apparatus. A nitrogen gas is used as an adsorption gas and a value calculated by a BET multipoint method is defined as the BET specific surface area of the inorganic fine particles in the present invention.

It should be noted that the BET specific surface area is calculated as described below.

First, the inorganic fine particles are caused to adsorb the nitrogen gas, and an equilibrium pressure P (Pa) in a sample cell and a nitrogen adsorption amount Va (mol/g) of the external additive at that time are measured. Then, an adsorption isotherm is obtained, whose axis of abscissa indicates a relative pressure Pr as a value obtained by dividing the equilibrium pressure P (Pa) in the sample cell by a saturated vapor pressure Po (Pa) of nitrogen and whose axis of ordinate indicates the nitrogen adsorption amount Va (mol/g). Next, a monomolecular layer adsorption amount Vm (mol/g) as an adsorption amount needed for forming a monomolecular layer on the surface of the external additive is determined by applying the following BET equation.

$$Pr/Va(1-Pr)=1/(Vm\times C)+(C-1)\times Pr/(Vm\times C)$$

Here, C represents a BET parameter and is a variable that varies depending on the kind of the measurement sample, the kind of the adsorption gas, and an adsorption temperature.

The BET equation can be interpreted as a straight line having a slope of (C−1)/(Vm×C) and an intercept of 1/(Vm×C) when the X-axis indicates the Pr and the Y-axis indicates the Pr/Va(1−Pr). The straight line is referred to as "BET plot."

$$\text{Slope of straight line}=(C-1)/(Vm\times C)$$

$$\text{Intercept of straight line}=1/(Vm\times C)$$

When an actual value for the Pr and an actual value for the Pr/Va(1−Pr) are plotted on a graph, and a straight line is drawn by the method of least squares, values for the slope and intercept of the straight line can be calculated. The Vm and the C can be calculated by substituting those values into the mathematical expression and solving the resultant simultaneous equations.

Further, a BET specific surface area S ($m^2/g$) of the inorganic fine particles is calculated from the Vm calculated here and a sectional area (0.162 $nm^2$) occupied by a nitrogen molecule based on the following equation.

$$S=Vm\times N\times 0.162\times 10^{-18}$$

Here, N represents Avogadro's number ($mol^{-1}$).

Although the measurement involving using the apparatus is in conformity with the "TriStar 3000 Instruction Manual V4.0" included with the apparatus, the measurement is specifically performed by the following procedure.

The tare mass of a dedicated sample cell made of a glass (having a stem diameter of ⅜ inch and a volume of about 5 ml) that has been sufficiently washed and dried is precisely weighed. Then, about 0.1 g of the external additive is loaded into the sample cell by using a funnel.

The sample cell into which the inorganic fine particles have been loaded is set in a "pretreatment apparatus VACUPREP 061 (manufactured by Shimadzu Corporation)" having connected thereto a vacuum pump and a nitrogen gas piping, and vacuum deaeration is continued for about 10 hours at 23° C. It should be noted that at the time of the vacuum deaeration, the inside of the sample cell is gradually deaerated while a valve is adjusted so that the inorganic fine particles may not be sucked by the vacuum pump. As the deaeration progresses, a pressure in the sample cell gradually reduces and finally reaches about 0.4 Pa (about 3 mmTorr). After the completion of the vacuum deaeration, a nitrogen gas is gradually injected into the sample cell to return the pressure in the sample cell to atmospheric pressure, and the sample cell is removed from the pretreatment apparatus. Then, the mass of the sample cell is precisely weighed, and the accurate mass of the external additive is calculated from a difference between the mass and the tare mass. It should be noted that at this time, the sample cell is lidded with a rubber stopper during the weighing so that the external additive in the sample cell may not be contaminated by, for example, moisture in the air.

Next, a dedicated "isothermal jacket" is attached to the stem portion of the sample cell containing the inorganic fine particles. Then, a dedicated filler rod is inserted into the sample cell and the sample cell is set in the analysis port of the apparatus. It should be noted that the isothermal jacket is a tubular member that can take up liquid nitrogen to a certain level by virtue of capillarity, and has an inner surface constituted of a porous material and an outer surface constituted of an impervious material.

Subsequently, the free space of the sample cell including a connecting tool is measured. The free space is calculated by: measuring the volume of the sample cell at 23° C. with a helium gas; then similarly measuring the volume of the sample cell after the cooling of the sample cell with liquid nitrogen with a helium gas; and converting a difference between these volumes. In addition, the saturated vapor pressure Po (Pa) of nitrogen is separately measured in an automatic manner with a Po tube built in the apparatus.

Next, the inside of the sample cell is subjected to vacuum deaeration and then the sample cell is cooled with liquid nitrogen while the vacuum deaeration is continued. After that, a nitrogen gas is introduced into the sample cell in a stepwise manner and the toner is caused to adsorb a nitrogen molecule. At this time, the adsorption isotherm is obtained by measuring the equilibrium pressure P (Pa) whenever necessary and the adsorption isotherm is transformed into the BET plot. It should be noted that the number of points of the relative pressure Pr at which data is collected is set to a total of 6, i.e., 0.05, 0.10, 0.15, 0.20, 0.25, and 0.30. A straight line is drawn on the measured data thus obtained by the method of least squares, and the Vm is calculated from the slope and intercept of the straight line. Further, the BET specific surface area of the inorganic fine particles is calculated by using the value for the Vm as described above.

<5. Measurement of Weight-Average Particle Diameter (D4) of Toner Particles>

The weight-average particle diameter (D4) of the toner particles is measured with the number of effective measurement channels of 25,000 by using a precision particle size distribution-measuring apparatus based on a pore electrical resistance method provided with a 100-μm aperture tube "Coulter Counter Multisizer 3" (trademark, manufactured by Beckman Coulter, Inc.) and dedicated software included therewith "Beckman Coulter Multisizer 3 Version 3.51" (manufactured by Beckman Coulter, Inc.) for setting measurement conditions and analyzing measurement data. Then, the measurement data is analyzed to calculate the diameter.

An electrolyte aqueous solution prepared by dissolving guaranteed sodium chloride in deionized water so as to have a concentration of about 1 mass %, for example, "ISOTON II" (manufactured by Beckman Coulter, Inc.) can be used in the measurement.

It should be noted that the dedicated software is set as described below prior to the measurement and the analysis.

In the "change standard measurement method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a threshold/noise level measurement button. In addition, a current is set to 1,600 ρA, a gain is set to 2, and an electrolyte solution is set to "ISOTON II", and a check mark is placed in a check box as to whether the aperture tube is flushed after the measurement.

In the "setting for conversion from pulse to particle diameter" screen of the dedicated software, a bin interval is set to a logarithmic particle diameter, the number of particle diameter bins is set to 256, and a particle diameter range is set to the range of from 2 μm or more to 60 μm or less.

A specific measurement method is as described below in sections (1) to (7).

(1) About 200 ml of the electrolyte aqueous solution are charged into a 250-ml round-bottom beaker made of glass dedicated for the Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "aperture flush" function of the analytical software.

(2) About 30 ml of the electrolyte aqueous solution are charged into a 100-ml flat-bottom beaker made of glass. About 0.3 ml of a diluted solution prepared by diluting "Contaminon N" (a 10 mass % aqueous solution of a neutral detergent for washing a precision measuring device formed of a nonionic surfactant, an anionic surfactant, and an organic builder and having a pH of 7 manufactured by Wako Pure Chemical Industries, Ltd.) with deionized water by three mass fold is added as a dispersant to the electrolyte aqueous solution.

(3) In an ultrasonic dispersing unit, two oscillators each having an oscillatory frequency of 50 kHz are built so as to be out of phase by 180°. A predetermined amount of deionized water is charged into the water tank of the ultrasonic dispersing unit "Ultrasonic Dispension System Tetora 150" (manufactured by Nikkaki Bios Co., Ltd.) having an electrical output of 120 W. About 2 ml of the "Contaminon N" are charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of toner are gradually added to and dispersed in the electrolyte aqueous solution in the beaker in the section (4) in a state in which the electrolyte aqueous solution is irradiated with the ultrasonic wave. Then, the ultrasonic dispersion treatment is continued for an additional 60 seconds. It should be noted that the temperature of water in the water tank is adjusted so as to be from 10° C. or more to 40° C. or less upon ultrasonic dispersion.

(6) The electrolyte aqueous solution in the section (5) in which the toner has been dispersed is dropped with a pipette to the round-bottom beaker in the section (1) placed in the sample stand, and the concentration of the toner to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. It should be noted that an "average diameter" on the "analysis/volume statistics (arithmetic average)" screen of the dedicated software when the dedicated software is set to show a graph in a vol % unit is the weight-average particle diameter (D4).

<6. Measurement of Average Circularity of Toner>

The average circularity of the toner is measured under measurement and analysis conditions at the time of calibration operation with a flow-type particle image analyzer "FPIA-3000" (manufactured by Sysmex Corporation).

The measurement principle of the flow-type particle image analyzer "FPIA-3000" (manufactured by Sysmex Corporation) is as follows: a flowing particle is photographed as a static image and the image is analyzed. A sample loaded into a sample chamber is fed into a flat sheath flow cell by a sample suction syringe. The sample fed into the flat sheath flow cell is sandwiched between sheath liquids to form a flat flow. The sample passing the inside of the flat sheath flow cell is irradiated with strobe light at an interval of 1/60 second, and hence the flowing particle can be photographed as the static image. In addition, the particle is photographed in a state of being in focus because the flow is flat. The particle image is taken with a CCD camera, the taken image is subjected to image processing at an image processing resolution of 512×512 pixels (0.37×0.37 μm per pixel), the borders of the respective particle images are sampled, and a projected area S, perimeter L, and the like of each particle image are measured.

Next, a circle-equivalent diameter and a circularity are determined by using the area S and the perimeter L. The circle-equivalent diameter refers to the diameter of a circle having the same area as the projected area of a particle image, and the circularity C is defined as a value obtained by dividing the perimeter of a circle determined from the circle-equivalent diameter by the perimeter of a particle projected image and is calculated from the following equation.

$$\text{Circularity } C=2\times(\pi\times S)^{1/2}/L:$$

When a particle image is circular, its circularity becomes 1.000. As the degree of unevenness of the outer periphery of the particle image enlarges, the value for the circularity reduces. After the circularity of each particle has been calculated, the circularity range of from 0.200 to 1.000 is divided into 800 sections, the arithmetic average of the resultant circularities is calculated, and the value is defined as an average circularity.

A specific measurement method is as described below. First, about 20 ml of ion-exchanged water from which an impure solid and the like have been removed in advance are charged into a container made of a glass. About 0.2 ml of a diluted solution prepared by diluting "Contaminon N" with deionized water by about three mass fold is added as a dispersant to the container. Further, about 0.02 g of a measurement sample is added to the container, and then the mixture is subjected to a dispersion treatment with an ultrasonic dispersing unit for 2 minutes so that a dispersion liquid for measurement may be obtained. At that time, the dispersion liquid is appropriately cooled so as to have a temperature of 10° C. or more to 40° C. or less. A desktop ultrasonic cleaning and dispersing unit having an oscillatory frequency of 50 kHz and an electrical output of 150 W (such as "VS-150" (manufactured by VELVO-CLEAR)) is used as the ultrasonic dispersing unit. A predetermined amount of deionized water is charged into a water tank, and about 2 ml of the Contaminon N are added to the water tank.

The flow-type particle image analyzer mounted with a standard objective lens (magnification: 10) is used in the measurement, and a particle sheath "PSE-900A" (manufactured by Sysmex Corporation) is used as a sheath liquid. The dispersion liquid prepared in accordance with the procedure is introduced into the flow-type particle image analyzer, and 3,000 toner particles are subjected to measurement according to the total count mode of an HPF measurement mode. Then, the number percentage (%) and average circularity of the toner particles in the range can be calculated by setting a binarization threshold at the time of particle analysis to 85% and specifying particle diameters to be analyzed. The average circularity of the toner is determined by limiting to one corresponding to a circle-equivalent diameter of 1.98 μm or more to 39.69 μm or less.

On the measurement, automatic focusing is performed with standard latex particles (obtained by diluting, for example, "RESEARCH AND TEST PARTICLES Latex Microsphere Suspensions 5200A" manufactured by Duke Scientific with deionized water) prior to the initiation of the measurement. After that, focusing is preferably performed every two hours from the initiation of the measurement.

It should be noted that in this example, a flow-type particle image analyzer which had been subjected to a calibration operation by Sysmex Corporation and received a calibration certificate issued by Sysmex Corporation was used. The measurement was performed under measurement and analysis conditions identical to those at the time of the reception of the calibration certificate except that particle diameters to be analyzed were limited to ones each corresponding to a circle-equivalent diameter of 1.98 μm or more to less than 39.69 μm.

<7. Measurement of Acid Value of Resin>

The acid value of a polyester resin is measured by the following method. The acid value refers to the number of milligrams of potassium hydroxide needed for neutralizing an acid in 1 g of a sample. The acid value of the polyester resin is measured in conformity with JIS K 0070-1992. Specifically, the measurement is performed by the following procedure.

(1) Preparation of Reagent 1.0 Gram of phenolphthalein is dissolved in 90 ml of ethyl alcohol (95 vol %) and deionized water is added to the solution to increase its volume to 100 ml. Thus, a phenolphthalein solution is obtained.

7 Grams of special grade potassium hydroxide are dissolved in 5 ml of deionized water and ethyl alcohol (95 vol %) is added to the solution to increase its volume to 1 liter. The solution is charged into an alkali-resistant container so as to be out of contact with a carbon dioxide gas or the like, and is left to stand for 3 days. After that, the solution is filtered to provide a potassium hydroxide solution. The resultant potassium hydroxide solution is stored in an alkali-resistant container. The factor of the potassium hydroxide solution is determined as follows: 25 ml of a 0.1 mol/1 hydrochloric acid are taken in an Erlenmeyer flask, several droplets of the phenolphthalein solution are added to the flask, the hydrochloric acid is titrated with the potassium hydroxide solution, and the amount of the potassium hydroxide solution needed for neutralization is used in the determination. A hydrochloric acid produced in conformity with JIS K 8001-1998 is used as the 0.1 mol/1 hydrochloric acid.

(2) Operation (A) Main Test 2.0 Grams of a sample of a pulverized polyester resin are precisely weighed in a 200-ml Erlenmeyer flask, and 100 ml of a mixed solution containing toluene and ethanol at a ratio of 2:1 are added to dissolve the sample over 5 hours. Next, several droplets of the phenolphthalein solution are added as an indicator and the solution is titrated with the potassium hydroxide solution. It should be noted that the end point of the titration is defined as the point at which the light pink color of the indicator continues for about 30 seconds.

(B) Blank Test

The same titration as the foregoing operations is performed except that no sample is used (i.e., only the mixed solution containing toluene and ethanol at a ratio of 2:1 is used).

(3) The acid value is calculated by substituting the obtained result into the following equation.

$$A=[(C-B)\times f\times 5.61]/S$$

Here, A represents the acid value (mgKOH/g), B represents the addition amount (ml) of the potassium hydroxide solution in the blank test, C represents the addition amount (ml) of the potassium hydroxide solution in the main test, f represents the factor of the potassium hydroxide solution, and S represents the sample (g).

(Production Example of Binder Resin)

PRODUCTION EXAMPLE A1

56.2 Parts by mass (0.158 mol: 97 mol % with respect to the total number of moles of polyhydric alcohols) of a polyoxypropylene(2.2)-2,2-bis(4-hydroxyphenyl)propane, 16.9 parts by mass (0.102 mol: 55 mol % with respect to the total number of moles of polyvalent carboxylic acids) of terephthalic acid, 1.1 parts by mass (0.0016 mol: 3 mol % with respect to the total number of moles of the polyhydric alcohols) of a novolac type phenol resin (adduct with 5 mol of ethylene oxide having a nucleus number of about 5), 6.4 parts by mass (0.044 mol: 25 mol % with respect to the total number of moles of the polyvalent carboxylic acids) of adipic acid, and 0.6 part by mass of titanium tetrabutoxide were loaded into a 4-liter four-necked flask made of a glass. Then, a temperature gauge, a stirring rod, a condenser, and a nitrogen-introducing tube were attached to the four-necked flask, and the four-necked flask was placed in a mantle heater. Next, an atmosphere in the flask was replaced with a nitrogen gas, and then a temperature in the flask was gradually increased while the contents were stirred. The contents were subjected to a reaction for 2 hours while being stirred at a temperature of 200° C. (first reaction step). After that, 5.8 parts by mass (0.030 mol: 20 mol % with respect to the total number of moles of the polyvalent carboxylic acids) of trimellitic anhydride were added to the resultant, and the mixture was subjected to a reaction at 180° C. for 10 hours (second reaction step). Thus, a polyester resin A1 was obtained.

The polyester resin A1 had a softening point of 150° C. and an acid value of 20 mgKOH/g. In addition, the resin had a Tg(80) of 60.0° C. and a Tg(180) of 59.8° C. Table 1 shows components constituting the polyhydric alcohol unit of the polyester resin A1 and components constituting the polyvalent carboxylic acid unit thereof. In addition, Table 2 shows the physical properties of the polyester resin A1.

PRODUCTION EXAMPLE A2

A polyester resin A2 was obtained by performing a reaction in the same manner as in Production Example A1 except that in the second reaction step, after the addition of trimellitic anhydride, the pressure in the flask was reduced to from 500 Pa or more to 2,000 Pa or less, and the reaction was performed at 160° C. for 5 hours. Table 2 shows the physical properties of the polyester resin A2.

PRODUCTION EXAMPLES A3 TO A6, A20, AND A21

Polyester resins A3 to A6, A20, and A21 were each obtained by performing a reaction in the same manner as in Production Example A1 except that the reaction time for the second reaction step was changed.

PRODUCTION EXAMPLES A7 TO A11, A22, AND A23

Polyester resins A7 to A11, A22, and A23 were each obtained by performing a reaction in the same manner as in Production Example A1 except that the polyhydric alcohol components used in the first reaction step and their molar ratios were changed as shown in Table 1. At that time, the number of parts by mass of each raw material was adjusted so that the total number of moles of the polyhydric alcohols became equal to that of Production Example A1.

PRODUCTION EXAMPLES A12 TO A17 AND A24 to A27

Polyester resins A12 to A17 and A24 to A27 were each obtained by performing a reaction in the same manner as in Production Example A1 except that the polyvalent carboxylic acid components used in the first reaction step and their molar ratios were changed as shown in Table 1. At that time, the number of parts by mass of each raw material was adjusted so that the total number of moles of the polyvalent carboxylic acids became equal to that of Production Example A1.

PRODUCTION EXAMPLE A18

A polyester resin A18 was obtained by performing a reaction in the same manner as in Production Example A1 except that: the polyvalent carboxylic acid components used in the first reaction step and the second reaction step, and their molar ratios were changed as shown in Table 1; and the reaction time for the second reaction step was changed to 12 hours. At that time, the number of parts by mass of each raw material was adjusted so that the total number of moles of the polyvalent carboxylic acids became equal to that of Production Example A1.

PRODUCTION EXAMPLE A19

A polyester resin A19 was obtained by performing a reaction in the same manner as in Production Example A1 except that: the polyvalent carboxylic acid components used in the first reaction step and the second reaction step, and their molar ratios were changed as shown in Table 1; and the reaction time for the second reaction step was changed to 7 hours. At that time, the number of parts by mass of each raw material was adjusted so that the total number of moles of the polyvalent carboxylic acids became equal to that of Production Example A1.

PRODUCTION EXAMPLE B1

59.3 Parts by mass (0.167 mol: 100 mol % with respect to the total number of moles of polyhydric alcohols) of a polyoxypropylene(2.2)-2,2-bis(4-hydroxyphenyl)propane, 24.2 parts by mass (0.146 mol: 94 mol % with respect to the total number of moles of polyvalent carboxylic acids) of terephthalic acid, 0.48 part by mass (0.0016 mol: 1 mol % with respect to the total number of moles of the polyvalent carboxylic acids) of fumaric acid, and 0.5 part by mass of titanium tetrabutoxide were loaded into a 4-liter four-necked flask made of a glass. Then, a temperature gauge, a stirring rod, a condenser, and a nitrogen-introducing tube were attached to the four-necked flask, and the four-necked flask was placed in a mantle heater. Next, an atmosphere in the flask was replaced with a nitrogen gas, and then a temperature in the flask was gradually increased while the contents were stirred. The contents were subjected to a reaction for 4 hours while being stirred at a temperature of 200° C. (first reaction step). After that, 1.6 parts by mass (0.008 mol: 5 mol % with respect to the total number of moles of the polyvalent carboxylic acids) of trimellitic anhydride were added to the resultant, and the mixture was subjected to a reaction at 180° C. for 1 hour (second reaction step). Thus, a polyester resin B1 was obtained.

The polyester resin B1 had a softening point of 90° C. and an acid value of 6 mgKOH/g. In addition, the resin had a Tg(80) of 56.0° C. and a Tg(180) of 56.0° C. Table 1 shows the polyhydric alcohol components constituting the polyhydric alcohol unit of the polyester resin B1 and the polyvalent carboxylic acid components constituting the polyvalent carboxylic acid unit thereof. Table 2 shows the physical properties of the polyester resin B1.

PRODUCTION EXAMPLES B2 TO B5, B7, AND B15

Polyester resins B2 to B5, B7, and B15 were each obtained by performing a reaction in the same manner as in Production Example B1 except that the polyvalent carboxylic acid components used in the first reaction step and their molar ratios were changed as shown in Table 1. At that time, the number of parts by mass of each raw material was adjusted so that the total number of moles of the polyvalent carboxylic acids became equal to that of Production Example B1.

PRODUCTION EXAMPLES B6 AND B12

Polyester resins B6 and B12 were each obtained by performing a reaction in the same manner as in Production Example B1 except that: the polyvalent carboxylic acid components used in the first reaction step and their molar ratios were changed as shown in Table 1; and the second reaction step was not performed. At that time, the number of parts by mass of each raw material was adjusted so that the total number of moles of the polyvalent carboxylic acids became equal to that of Production Example B1.

PRODUCTION EXAMPLES B8 TO B11, B13, AND B14

Polyester resins B8 to B11, B13, and B14 were each obtained by performing a reaction in the same manner as in Production Example B1 except that the reaction time for the first reaction step was changed.

PRODUCTION EXAMPLE B16

Polyester resin B16 was obtained by performing a reaction in the same manner as in Production Example B1 except that the polyhydric alcohol components used in the first reaction step and their molar ratios were changed as shown in Table 1. At that time, the number of parts by mass of each raw material was adjusted so that the total number of moles of the polyhydric alcohols became equal to that of Production Example B1.

TABLE 1

| Polyester resin | Polyhydric alcohol component (mol %) First reaction step | | | | Polyvalent carboxylic acid component (mol %) First reaction step | | | | | | | Second reaction step | |
|---|---|---|---|---|---|---|---|---|---|---|---|---|---|
| | BPA-PO | NBP | EG | Total | TPA | SUA | AA | SEA | TDA | ODA | FA | TMA | Total |
| A1 | 97 | 3 | | 100 | 55 | | 25 | | | | | 20 | 100 |
| A2 | 97 | 3 | | 100 | 55 | | 25 | | | | | 20 | 100 |
| A3 | 97 | 3 | | 100 | 55 | | 25 | | | | | 20 | 100 |
| A4 | 97 | 3 | | 100 | 55 | | 25 | | | | | 20 | 100 |
| A5 | 97 | 3 | | 100 | 55 | | 25 | | | | | 20 | 100 |
| A6 | 97 | 3 | | 100 | 55 | | 25 | | | | | 20 | 100 |
| A7 | 99 | 1 | | 100 | 55 | | 25 | | | | | 20 | 100 |
| A8 | 99.5 | 0.5 | | 100 | 55 | | 25 | | | | | 20 | 100 |
| A9 | 99.8 | 0.2 | | 100 | 55 | | 25 | | | | | 20 | 100 |
| A10 | 99.9 | 0.1 | | 100 | 55 | | 25 | | | | | 20 | 100 |
| A11 | 90 | 10 | | 100 | 55 | | 25 | | | | | 20 | 100 |
| A12 | 97 | 3 | | 100 | 65 | | 15 | | | | | 20 | 100 |
| A13 | 97 | 3 | | 100 | 45 | | 35 | | | | | 20 | 100 |
| A14 | 97 | 3 | | 100 | 30 | | 50 | | | | | 20 | 100 |
| A15 | 97 | 3 | | 100 | 55 | | | 25 | | | | 20 | 100 |
| A16 | 97 | 3 | | 100 | 55 | | | | 25 | | | 20 | 100 |
| A17 | 97 | 3 | | 100 | 55 | | | | | 25 | | 20 | 100 |
| A18 | 97 | 3 | | 100 | 65 | | 25 | | | | | 10 | 100 |
| A19 | 97 | 3 | | 100 | 45 | | 25 | | | | | 30 | 100 |
| A20 | 97 | 3 | | 100 | 55 | | 25 | | | | | 20 | 100 |
| A21 | 97 | 3 | | 100 | 55 | | 25 | | | | | 20 | 100 |
| A22 | 100 | 0 | | 100 | 55 | | 25 | | | | | 20 | 100 |
| A23 | 85 | 15 | | 100 | 55 | | 25 | | | | | 20 | 100 |
| A24 | 97 | 3 | | 100 | 80 | | | | | | | 20 | 100 |
| A25 | 97 | 3 | | 100 | 70 | | 10 | | | | | 20 | 100 |
| A26 | 97 | 3 | | 100 | 20 | | 60 | | | | | 20 | 100 |
| A27 | 97 | 3 | | 100 | 55 | 25 | | | | | | 20 | 100 |
| B1 | 100 | | | 100 | 94 | | | | | | 1 | 5 | 100 |
| B2 | 100 | | | 100 | 94.5 | | | | | | 0.5 | 5 | 100 |
| B3 | 100 | | | 100 | 94.8 | | | | | | 0.2 | 5 | 100 |
| B4 | 100 | | | 100 | 94.9 | | | | | | 0.1 | 5 | 100 |
| B5 | 100 | | | 100 | 92 | | | | | | 3 | 5 | 100 |
| B6 | 100 | | | 100 | 90 | | | | | | 10 | | 100 |
| B7 | 100 | | | 100 | 95 | | | | | | | 5 | 100 |
| B8 | 100 | | | 100 | 95 | | | | | | | 5 | 100 |
| B9 | 100 | | | 100 | 95 | | | | | | | 5 | 100 |
| B10 | 100 | | | 100 | 95 | | | | | | | 5 | 100 |
| B11 | 100 | | | 100 | 95 | | | | | | | 5 | 100 |
| B12 | 100 | | | 100 | 100 | | | | | | | | 100 |
| B13 | 100 | | | 100 | 94 | | | | | | 1 | 5 | 100 |
| B14 | 100 | | | 100 | 94 | | | | | | 1 | 5 | 100 |
| B15 | 80 | | 20 | 100 | 94 | | | | | | 1 | 5 | 100 |
| B16 | 100 | | | 100 | 80 | | | | | | 15 | 5 | 100 |

BPA-PO propylene oxide adduct of bisphenol A (average addition number of moles: 2.2 mol)
NBP novolac type phenol resin (adduct with 5 mol of ethylene oxide having a nucleus number of about 5)
EG ethylene glycol
TPA terephthalic acid
SUA succinic acid
AA adipic acid
SEA sebacic acid
TDA tetradecanedioic acid
ODA octadecanedioic acid
FA fumaric acid
TMA trimellitic anhydride

TABLE 2

| Polyester resin | Softening point | Tg(80) | Tg(180) | Tg(80) – Tg(180) | Acid value [mg/KOH] |
|---|---|---|---|---|---|
| A1 | 150° C. | 60.0° C. | 59.8° C. | 0.2° C. | 20 |
| A2 | 150° C. | 61.0° C. | 59.8° C. | 1.2° C. | 20 |
| A3 | 140° C. | 59.4° C. | 59.0° C. | 0.4° C. | 20 |
| A4 | 125° C. | 53.6° C. | 53.2° C. | 0.4° C. | 20 |
| A5 | 160° C. | 60.4° C. | 60.2° C. | 0.2° C. | 20 |
| A6 | 175° C. | 64.2° C. | 63.8° C. | 0.4° C. | 20 |
| A7 | 150° C. | 59.8° C. | 59.4° C. | 0.4° C. | 20 |

TABLE 2-continued

| Polyester resin | Softening point | Tg(80) | Tg(180) | Tg(80) – Tg(180) | Acid value [mg/KOH] |
|---|---|---|---|---|---|
| A8 | 150° C. | 59.8° C. | 59.0° C. | 0.8° C. | 20 |
| A9 | 150° C. | 59.6° C. | 59.0° C. | 0.6° C. | 20 |
| A10 | 150° C. | 59.6° C. | 59.0° C. | 0.6° C. | 20 |
| A11 | 150° C. | 61.2° C. | 60.8° C. | 0.4° C. | 20 |
| A12 | 150° C. | 59.6° C. | 59.4° C. | 0.2° C. | 20 |
| A13 | 150° C. | 59.2° C. | 59.0° C. | 0.2° C. | 20 |
| A14 | 150° C. | 58.8° C. | 59.0° C. | −0.2° C. | 20 |

TABLE 2-continued

| Polyester resin | Softening point | Tg(80) | Tg(180) | Tg(80) – Tg(180) | Acid value [mg/KOH] |
|---|---|---|---|---|---|
| A15 | 150° C. | 58.4° C. | 58.8° C. | −0.4° C. | 20 |
| A16 | 150° C. | 57.8° C. | 58.2° C. | −0.4° C. | 20 |
| A17 | 150° C. | 58.0° C. | 57.8° C. | 0.2° C. | 20 |
| A18 | 150° C. | 58.4° C. | 58.2° C. | 0.2° C. | 8 |
| A19 | 150° C. | 60.2° C. | 60.2° C. | 0.0° C. | 50 |
| A20 | 115° C. | 53.0° C. | 52.8° C. | 0.2° C. | 20 |
| A21 | 185° C. | 66.2° C. | 65.8° C. | 0.4° C. | 20 |
| A22 | 150° C. | 61.2° C. | 61.2° C. | 0.0° C. | 20 |
| A23 | 150° C. | 59.8° C. | 59.6° C. | 0.2° C. | 20 |
| A24 | 150° C. | 60.4° C. | 59.6° C. | 0.8° C. | 20 |
| A25 | 150° C. | 61.4° C. | 61.0° C. | 0.4° C. | 20 |
| A26 | 150° C. | 59.6° C. | 58.8° C. | 0.8° C. | 20 |
| A27 | 150° C. | 60.4° C. | 59.8° C. | 0.6° C. | 20 |
| B1 | 90° C. | 56.0° C. | 56.0° C. | 0.0° C. | 6 |
| B2 | 90° C. | 56.0° C. | 56.0° C. | 0.0° C. | 6 |
| B3 | 90° C. | 56.0° C. | 56.0° C. | 0.0° C. | 6 |
| B4 | 90° C. | 56.0° C. | 56.0° C. | 0.0° C. | 6 |
| B5 | 90° C. | 55.6° C. | 55.6° C. | 0.0° C. | 6 |
| B6 | 90° C. | 55.0° C. | 55.0° C. | 0.0° C. | 2 |
| B7 | 90° C. | 56.0° C. | 56.0° C. | 0.0° C. | 6 |
| B8 | 86° C. | 53.4° C. | 53.4° C. | 0.0° C. | 6 |
| B9 | 82° C. | 50.8° C. | 50.8° C. | 0.0° C. | 6 |
| B10 | 94° C. | 57.2° C. | 57.2° C. | 0.0° C. | 6 |
| B11 | 99° C. | 61.2° C. | 61.2° C. | 0.0° C. | 6 |
| B12 | 90° C. | 55.6° C. | 55.6° C. | 0.0° C. | 2 |
| B13 | 77° C. | 49.4° C. | 49.4° C. | 0.0° C. | 6 |
| B14 | 103° C. | 65.6° C. | 65.6° C. | 0.0° C. | 6 |
| B15 | 90° C. | 54.6° C. | 54.6° C. | 0.0° C. | 6 |
| B16 | 90° C. | 54.2° C. | 54.2° C. | 0.0° C. | 6 |

PRODUCTION EXAMPLE C1

Materials shown in Table 3 below were loaded into an autoclave having a volume of 4 L and an atmosphere in the system was replaced with nitrogen. After that, a temperature in the system was increased and held at 180° C. while the materials were stirred. 50 Parts by mass of a 2 mass % solution of di-tert-butyl peroxide in xylene were continuously dropped to the system for 5 hours and the mixture was cooled. After that, the solvent was separated and removed. Thus, a polymer C1 in which a copolymer was grafted to the polyethylene was obtained. The polymer C1 had a softening point (Tm) of 110° C. and a glass transition temperature (Tg) of 64° C., and the weight-average molecular weight (Mw) and number-average molecular weight (Mn) of the THF soluble matter of the polymer C1 measured by GPC were 7,400 and 2,800, respectively. No peak corresponding to the polyethylene having one or more unsaturated bonds as a raw material was observed.

TABLE 3

| Material | Part(s) by mass |
|---|---|
| Polyethylene having one or more unsaturated bonds (Mw: 1,400, Mn: 850, endothermic peak measured with DSC: 100° C.) | 20 |
| Styrene | 59 |
| n-Butyl acrylate | 18.5 |
| Acrylonitrile | 2.5 |

EXAMPLE 1

Materials shown in Table 4 below were mixed with a Henschel mixer (Model FM-75 manufactured by NIPPON COKE & ENGINEERING CO., LTD.) at a number of rotations of 20 rotations/sec for a time of rotation of 5 minutes. After that, the mixture was kneaded with a twin-screw extruder (Model PCM-30 manufactured by Ikegai Corporation) whose temperature had been set to 130° C.

TABLE 4

| Material | Part(s) by mass |
|---|---|
| Polyester resin A1 | 25 |
| Polyester resin B1 | 75 |
| Polymer C1 | 5 |
| Hydrocarbon wax (peak temperature of highest endothermic peak: 78° C.) | 6 |
| C.I. Pigment Blue 15:3 | 5 |
| Aluminum compound of 3,5-di-t-butylsalicylic acid | 0.5 |

The resultant kneaded product was cooled and coarsely pulverized with a hammer mill to 1 mm or less to provide a coarsely pulverized product. The resultant coarsely pulverized product was finely pulverized with a mechanical pulverizer (T-250 manufactured by FREUND-TURBO CORPORATION). Further, the finely pulverized product was classified with a Faculty F-300 (manufactured by Hosokawa Micron Corporation) to provide toner particles. Its operating conditions were as follows: the number of rotations of a classification rotor was set to 130 rotations/sec and the number of rotations of a dispersion rotor was set to 120 rotations/sec.

4.0 Parts by mass of hydrophobic silica fine particles subjected to a surface treatment with 4 mass % of hexamethyldisilazane and having a BET specific surface area of 25 $m^2/g$, and 0.5 part by mass of titanium oxide fine particles subjected to a surface treatment with 16 mass % of isobutyltrimethoxysilane and having a BET specific surface area of 180 $m^2/g$ were added to 100 parts by mass of the toner particles, and the contents were mixed with a Henschel mixer (Model FM-75 manufactured by NIPPON COKE & ENGINEERING CO., LTD.) at a number of rotations of 30 rotations/sec for a time of rotation of 10 minutes. The toner particles were thermally treated with the surface treatment apparatus illustrated in FIGURE to provide thermally treated toner particles. Its operating conditions were as follows: a feeding amount was set to 5 kg/hr, a hot air temperature was set to 210° C., a hot air flow rate was set to 6 $m^3$/min, a cold air temperature was set to 5° C., a cold air flow rate was set to 4 $m^3$/min, a cold air absolute moisture content was set to 3 $g/m^3$, a blower flow rate was set to 20 $m^3$/min, and an injection air flow rate was set to 1 $m^3$/min.

1.0 Part by mass of hydrophobic silica fine particles subjected to a surface treatment with 4 mass % of hexamethyldisilazane and having a BET specific surface area of 25 $m^2/g$, and 0.8 part by mass of hydrophobic silica fine particles subjected to a surface treatment with 10 mass % of polydimethylsiloxane and having a BET specific surface area of 100 $m^2/g$ were added to 100 parts by mass of the heat treated toner particles, and the contents were mixed with a Henschel mixer (Model FM-75 manufactured by NIPPON COKE & ENGINEERING CO., LTD.) at a number of rotations of 30 rotations/sec for a time of rotation of 10 minutes to obtain a toner 1. The toner 1 had a weight-average particle diameter (D4) of 6.2 μm and an average circularity of 0.965.

EXAMPLE 2

A toner 2 was produced in the same manner as in Example 1 except that in Example 1, the external addition step (addition of the silica fine particles) was not performed before the heat treatment step with the surface treatment apparatus. The toner 2 had a weight-average particle diameter (D4) of 6.2 μm and an average circularity of 0.955.

EXAMPLE 3

A toner 3 was produced in the same manner as in Example 2 except that the heat treatment with the surface treatment apparatus was not performed. The toner 3 had a weight-average particle diameter (D4) of 6.2 μm and an average circularity of 0.955.

EXAMPLE 4

A toner 4 was produced in the same manner as in Example 3 except that the apparatus used in the classification after the fine pulverization was changed from the Faculty F-300 (manufactured by Hosokawa Micron Corporation) to a rotary classifier TSP-200 (manufactured by Hosokawa Micron Corporation). The operating condition of the rotary classifier TSP-200 (manufactured by Hosokawa Micron Corporation) was as follows: the number of rotations of a classification rotor was set to 50.0 rotations/sec. The toner 4 had a weight-average particle diameter (D4) of 6.2 μm and an average circularity of 0.950.

EXAMPLES 5 AND 6

Toners 5 and 6 were each produced in the same manner as in Example 4 except that the number of parts by mass of the polymer C was changed as shown in Table 5. The toners 5 and 6 each had a weight-average particle diameter (D4) of 6.2 μm and an average circularity of 0.950.

EXAMPLES 7 TO 39

Toners 7 to 39 were each produced in the same manner as in Example 4 except that the hydrocarbon wax was changed to an ester wax (peak temperature of the highest endothermic peak: 85° C.) and the other materials were also changed as shown in Table 5. Each of those toners had a weight-average particle diameter (D4) of 6.2 μm and an average circularity of 0.950.

COMPARATIVE EXAMPLES 1 TO 14

Toners 40 to 53 were each produced in the same manner as in Example 4 except that the polyester resin A and the polyester resin B were changed as shown in Table 5. Each of those toners had a weight-average particle diameter (D4) of 6.2 μm and an average circularity of 0.950.

TABLE 5

| | | Polyester resin A | | Polyester resin B | | Mass | Polymer C | Max | |
|---|---|---|---|---|---|---|---|---|---|
| | Toner | Kind | Part (s) by mass | Kind | Part (s) by mass | ratio A/B | Part (s) by mass | Kind | Part (s) by mass |
| Example 1 | Toner 1 | A1 | 25 | B1 | 75 | 25/75 | 5 | Hydrocarbon wax | 6 |
| Example 2 | Toner 2 | A1 | 25 | B1 | 75 | 25/75 | 5 | Hydrocarbon wax | 6 |
| Example 3 | Toner 3 | A1 | 25 | B1 | 75 | 25/75 | 5 | Hydrocarbon wax | 6 |
| Example 4 | Toner 4 | A1 | 25 | B1 | 75 | 25/75 | 5 | Hydrocarbon wax | 6 |
| Example 5 | Toner 5 | A1 | 25 | B1 | 75 | 25/75 | 2 | Hydrocarbon wax | 6 |
| Example 6 | Toner 6 | A1 | 25 | B1 | 75 | 25/75 | None | Hydrocarbon wax | 6 |
| Example 7 | Toner 7 | A1 | 25 | B1 | 75 | 25/75 | None | Ester wax | 6 |
| Example 8 | Toner 8 | A1 | 25 | B2 | 75 | 25/75 | None | " | 6 |
| Example 9 | Toner 9 | A1 | 25 | B3 | 75 | 25/75 | None | " | 6 |
| Example 10 | Toner 10 | A1 | 25 | B4 | 75 | 25/75 | None | " | 6 |
| Example 11 | Toner 11 | A1 | 25 | B5 | 75 | 25/75 | None | " | 6 |
| Example 12 | Toner 12 | A1 | 25 | B6 | 75 | 25/75 | None | " | 6 |
| Example 13 | Toner 13 | A1 | 25 | B7 | 75 | 25/75 | None | " | 6 |
| Example 14 | Toner 14 | A2 | 25 | B7 | 75 | 25/75 | None | " | 6 |
| Example 15 | Toner 15 | A1 | 15 | B7 | 85 | 15/85 | None | " | 6 |
| Example 16 | Toner 16 | A1 | 40 | B7 | 60 | 40/60 | None | " | 6 |
| Example 17 | Toner 17 | A1 | 55 | B7 | 45 | 55/45 | None | " | 6 |
| Example 18 | Toner 18 | A3 | 25 | B7 | 75 | 25/75 | None | " | 6 |
| Example 19 | Toner 19 | A4 | 25 | B7 | 75 | 25/75 | None | " | 6 |
| Example 20 | Toner 20 | A5 | 25 | B7 | 75 | 25/75 | None | " | 6 |
| Example 21 | Toner 21 | A6 | 25 | B7 | 75 | 25/75 | None | " | 6 |
| Example 22 | Toner 22 | A1 | 25 | B8 | 75 | 25/75 | None | " | 6 |
| Example 23 | Toner 23 | A1 | 25 | B9 | 75 | 25/75 | None | " | 6 |
| Example 24 | Toner 24 | A1 | 25 | B10 | 75 | 25/75 | None | " | 6 |
| Example 25 | Toner 25 | A1 | 25 | B11 | 75 | 25/75 | None | " | 6 |
| Example 26 | Toner 26 | A7 | 25 | B7 | 75 | 25/75 | None | " | 6 |
| Example 27 | Toner 27 | A8 | 25 | B7 | 75 | 25/75 | None | " | 6 |
| Example 28 | Toner 28 | A9 | 25 | B7 | 75 | 25/75 | None | " | 6 |
| Example 29 | Toner 29 | A10 | 25 | B7 | 75 | 25/75 | None | " | 6 |
| Example 30 | Toner 30 | A11 | 25 | B7 | 75 | 25/75 | None | " | 6 |
| Example 31 | Toner 31 | A12 | 25 | B7 | 75 | 25/75 | None | " | 6 |
| Example 32 | Toner 32 | A13 | 25 | B7 | 75 | 25/75 | None | " | 6 |
| Example 33 | Toner 33 | A14 | 25 | B7 | 75 | 25/75 | None | " | 6 |
| Example 34 | Toner 34 | A15 | 25 | B7 | 75 | 25/75 | None | " | 6 |
| Example 35 | Toner 35 | A16 | 25 | B7 | 75 | 25/75 | None | " | 6 |

TABLE 5-continued

| | | Polyester resin A | | Polyester resin B | | Mass | Polymer C | Max | |
|---|---|---|---|---|---|---|---|---|---|
| | Toner | Kind | Part (s) by mass | Kind | Part (s) by mass | ratio A/B | Part (s) by mass | Kind | Part (s) by mass |
| Example 36 | Toner 36 | A17 | 25 | B7 | 75 | 25/75 | None | " | 6 |
| Example 37 | Toner 37 | A1 | 25 | B12 | 75 | 25/75 | None | " | 6 |
| Example 38 | Toner 38 | A18 | 25 | B7 | 75 | 25/75 | None | " | 6 |
| Example 39 | Toner 39 | A19 | 25 | B7 | 75 | 25/75 | None | " | 6 |
| Comparative Example 1 | Toner 40 | A1 | 5 | B1 | 95 | 5/95 | 5 | Hydrocarbon wax | 6 |
| Comparative Example 2 | Toner 41 | A1 | 65 | B1 | 35 | 65/35 | 5 | Hydrocarbon wax | 6 |
| Comparative Example 3 | Toner 42 | A20 | 25 | B1 | 75 | 25/75 | 5 | Hydrocarbon wax | 6 |
| Comparative Example 4 | Toner 43 | A21 | 25 | B1 | 75 | 25/75 | 5 | Hydrocarbon wax | 6 |
| Comparative Example 5 | Toner 44 | A1 | 25 | B13 | 75 | 25/75 | 5 | Hydrocarbon wax | 6 |
| Comparative Example 6 | Toner 45 | A1 | 25 | B14 | 75 | 25/75 | 5 | Hydrocarbon wax | 6 |
| Comparative Example 7 | Toner 46 | A22 | 25 | B1 | 75 | 25/75 | 5 | Hydrocarbon wax | 6 |
| Comparative Example 8 | Toner 47 | A23 | 25 | B1 | 75 | 25/75 | 5 | Hydrocarbon wax | 6 |
| Comparative Example 9 | Toner 48 | A24 | 25 | B1 | 75 | 25/75 | 5 | Hydrocarbon wax | 6 |
| Comparative Example 10 | Toner 49 | A25 | 25 | B1 | 75 | 25/75 | 5 | Hydrocarbon wax | 6 |
| Comparative Example 11 | Toner 50 | A26 | 25 | B1 | 75 | 25/75 | 5 | Hydrocarbon wax | 6 |
| Comparative Example 12 | Toner 51 | A27 | 25 | B1 | 75 | 25/75 | 5 | Hydrocarbon wax | 6 |
| Comparative Example 13 | Toner 52 | A1 | 25 | B15 | 75 | 25/75 | 5 | Hydrocarbon wax | 6 |
| Comparative Example 14 | Toner 53 | A1 | 25 | B16 | 75 | 25/75 | 5 | Hydrocarbon wax | 6 |

EXAMPLE 101

1. Production of Magnetic Core Particles

Ferrite raw materials shown in Table 6 below were weighed. After that, the raw materials were pulverized and mixed with a dry ball mill using a zirconia ball (ϕ10 mm) for 2 hours.

TABLE 6

| Ferrite raw material | | |
|---|---|---|
| Material | Mass % | Composition of ferrite |
| $Fe_2O_3$ | 60.2 | a = 0.39, b = 0.11, c = 0.01, and d = 0.50 |
| $MnCO_3$ | 33.9 | in $(MnO)_a(MgO)_b(SrO)_c(Fe_2O_3)_d$ |
| $Mg(OH)_2$ | 4.8 | |
| $SrCO_3$ | 1.1 | |

Next, the mixture was calcined with a burner-type kiln in the air at 1,000° C. for 3 hours to produce a calcined ferrite of the composition shown in the right column of Table 6. The calcined ferrite was pulverized with a crusher to about 0.5 mm. After that, 30 parts by mass of water were added to 100 parts by mass of the calcined ferrite, and the mixture was pulverized with a wet ball mill using a zirconia ball (ϕ10 mm) for 2 hours. A slurry thus obtained was pulverized with a wet bead mill using zirconia beads (ϕ1.0 mm) for 4 hours to provide a ferrite slurry. 2.0 Parts by mass of a polyvinyl alcohol with respect to 100 parts by mass of the calcined ferrite were added as a binder to the ferrite slurry, and the mixture was granulated with a spray dryer (manufacturer: OHKAWARA KAKOHKI CO., LTD.) into spherical particles each having a diameter of about 36 μm.

Next, the spherical particles were calcined in an electric furnace under a nitrogen atmosphere (having an oxygen concentration of 1.00 vol % or less) at 1,150° C. for 4 hours in order that a calcination atmosphere was controlled. Agglomerated particles obtained by the calcination were shredded and then coarse particles were removed by sieving with a sieve having an aperture of 250 μm. Thus, magnetic core particles 1 were obtained.

2. Production of Coating Resin

Materials shown in Table 7 below were added to a four-necked separable flask mounted with a reflux condenser, a temperature gauge, a nitrogen-introducing tube, and a stirring apparatus, and a nitrogen gas was introduced to sufficiently establish a nitrogen atmosphere in the flask. After that, a temperature in the flask was warmed to 80° C., 2.0 parts by mass of azobisisobutyronitrile were added to the mixture, and the whole was refluxed and polymerized for 5 hours. Hexane was injected into the resultant reaction product to precipitate and deposit a copolymer, and the precipitate was separated by filtration. After that, the precipitate was dried in a vacuum to provide a coating resin 1.

TABLE 7

| Material | Part(s) by mass |
|---|---|
| Cyclohexyl methacrylate monomer | 26.8 |
| Methyl methacrylate monomer | 0.2 |
| Methyl methacrylate macromonomer (macromonomer having a methacryloyl group at one terminal and mass-average molecular weight of 5,000) | 8.4 |

TABLE 7-continued

| Material | Part(s) by mass |
|---|---|
| Toluene | 31.3 |
| Methyl ethyl ketone | 31.3 |

3. Production of Magnetic Carrier 20.0 Parts by mass of the coating resin 1 and 80.0 parts by mass of toluene were dispersed and mixed with a bead mill to provide a resin liquid 1.

Next, 100 parts by mass of the magnetic core particles 1 were loaded into a Nauta mixer. Further, the resin liquid 1 was charged into the Nauta mixer so that its amount in terms of a resin component became 2.0 parts by mass. Under reduced pressure, the contents were heated to a temperature of 70° C. and mixed at 100 rpm, followed by the performance of solvent removal and an application operation over 4 hours. After that, the resultant sample was transferred to a *Julia* mixer and thermally treated under a nitrogen atmosphere at a temperature of 100° C. for 2 hours. After that, the resultant was classified with a sieve having an aperture of 70 μm to provide a magnetic carrier 1. The resultant magnetic carrier 1 had a 50% particle diameter (D50) on a volume distribution basis of 38.2 μm.

4. Production of Two-Component Developer

The toner 1 and the magnetic carrier 1 were mixed with a V-type mixer (Model V-10: TOKUJU CORPORATION) at a number of rotations of 0.5 rotation/sec for a time of rotation of 5 minutes so that a toner concentration became 8 mass %. Thus, a two-component developer 1 was obtained. The developer was subjected to the following evaluations.

5. Evaluation for Developability

A full-color copying machine imageRUNNER ADVANCE C9075PRO manufactured by Canon Inc. as an image-forming apparatus was reconstructed so that its process speed could be freely set, and the two-component developer 1 was evaluated.

An image output evaluation (A4 horizontal, print percentage: 80%, 5,000-sheet continuous passing) was performed under each of a normal-temperature and normal-humidity environment (having a temperature of 23° C. and a relative humidity of 50%), a normal-temperature and low-humidity environment (having a temperature of 23° C. and a relative humidity of 5%), and a high-temperature and high-humidity environment (having a temperature of 30° C. and a relative humidity of 80%), and under the following condition: the process speed was changed to 450 mm/sec. During a 5,000-sheet continuous passing time, sheet passing was performed under the same development condition and transfer condition (no calibration) as those of the first sheet. Used as evaluation paper was copier paper GF-0081 (A4, basis weight: 81.4 g/m$^2$, sold by Canon Marketing Japan Inc.). Under each of the evaluation environments, the toner laid-on level of an FFH image (solid portion) on the paper was adjusted to 0.45 mg/cm$^2$. The FFH image refers to a value obtained by representing 256 gray levels in a hexadecimal notation, and is such an image that OOH represents the first gray level (white portion) and FFH represents the 256-th gray level (solid portion).

The items and evaluation criteria of the image output evaluation at the initial stage (first sheet) and at the time of the 5,000-sheet continuous passing are shown below. In addition, Tables 9 to 11 show the results of the evaluations.

(1) Measurement of Image Density

The image densities of FFH image portions, i.e., solid portions at the initial stage (first sheet) and on the 5,000-th sheet were measured with an X-Rite Color Reflection Densitometer (500 Series: manufactured by X-Rite), and a difference A between both the image densities was ranked by the following criteria.

(Evaluation Criteria)

A: Less than 0.05 (The image density is extremely excellent.)

B: From 0.05 or more to less than 0.10 (The image density is good.)

C: From 0.10 or more to less than 0.20 (The image density is at the level at which the effect of the present invention is obtained.)

D: 0.20 or more (The image density is at the level at which the effect of the present invention is not sufficiently obtained.)

(2) Measurement of Fogging

An average reflectance Dr (%) of the evaluation paper before the image output was measured with a reflectometer ("REFLECTOMETER MODEL TC-6DS" manufactured by Tokyo Denshoku CO., LTD.). In addition, reflectances Ds (%) of OOH image portions, i.e., white portions at the initial stage (first sheet) and on the 5,000-th sheet were measured. Fogging (%) was calculated from the resultant Dr and Ds's (the initial stage (first sheet) and the 5,000-th sheet) by using the following equation. The resultant value for the fogging was ranked in accordance with the following evaluation criteria.

$$\text{Fogging (\%)} = Dr(\%) - Ds(\%)$$

(Evaluation Criteria)

A: Less than 0.5% (The fogging is extremely excellent.)

B: From 0.5% or more to less than 1.0% (The fogging is good.)

C: From 1.0% or more to less than 2.0% (The fogging is at the level at which the effect of the present invention is obtained.)

D: 2.0% or more (The fogging is at the level at which the effect of the present invention is not sufficiently obtained.)

(6. Evaluation for Fixability (Low-Temperature Fixability and Hot Offset Resistance))

A full-color copying machine imageRUNNER ADVANCE C9075PRO manufactured by Canon Inc. was reconstructed so that its fixation temperature and process speed could be freely set, and the two-component developer 1 was tested for its fixation temperature region. An unfixed image was produced according to a monochromatic mode while the toner laid-on level of the image on the paper under a normal-temperature and normal-humidity environment (having a temperature of 23° C. and a relative humidity of from 50% or more to 60% or less) was adjusted to 1.2 mg/cm$^2$. Copier paper GF-0081 (A4, basis weight: 81.4 g/m$^2$, sold by Canon Marketing Japan Inc.) was used as evaluation paper, and the image was formed at an image print percentage of 25%. After that, under the normal-temperature and normal-humidity environment (having a temperature of 23° C. and a relative humidity of from 50% or more to 60% or less), the process speed was set to 450 mm/sec, the fixation temperature was increased from 100° C. in increments of 5° C., and a temperature width in which no offset occurred (equal to or more than a fixable temperature and equal to or less than the temperature at which an offset occurred) was defined as a fixable region. The lower limit temperature of the fixable region was defined as a lower-limit fixation temperature and the upper limit temperature thereof was defined as a hot offset resistance temperature.

The lower-limit fixation temperature and the hot offset resistance temperature were ranked by the following criteria. Table 12 shows the results of the evaluation.

(Evaluation Criteria for Lower-Limit Fixation Temperature)

A: Less than 140° C. (The temperature is extremely excellent.)

B: From 140° C. or more to less than 150° C. (The temperature is good.)

C: From 150° C. or more to less than 160° C. (The temperature is at the level at which the effect of the present invention is obtained.)

D: 160° C. or more (The temperature is at the level at which the effect of the present invention is not sufficiently obtained.)

(Evaluation Criteria for Hot Offset Resistance Temperature)

A: 210° C. or more (The temperature is extremely excellent.)

B: From 200° C. or more to less than 210° C. (The temperature is good.)

C: From 190° C. or more to less than 195° C. (The temperature is at the level at which the effect of the present invention is obtained.)

D: Less than 190° C. (The temperature is at the level at which the effect of the present invention is not sufficiently obtained.)

EXAMPLES 102 TO 139 AND COMPARATIVE EXAMPLES 101 to 114

Evaluations were performed in the same manner as in Example 1 except that the two-component developer to be used in the evaluations was changed to two-component developers shown in Table 8. Tables 9 to 12 show the results of the evaluations.

TABLE 8

| | Toner | Magnetic carrier | Two-component developer |
|---|---|---|---|
| Example 101 | Toner 1 | Magnetic carrier 1 | Two-component developer 1 |
| Example 102 | Toner 2 | Magnetic carrier 1 | Two-component developer 2 |
| Example 103 | Toner 3 | Magnetic carrier 1 | Two-component developer 3 |
| Example 104 | Toner 4 | Magnetic carrier 1 | Two-component developer 4 |
| Example 105 | Toner 5 | Magnetic carrier 1 | Two-component developer 5 |
| Example 106 | Toner 6 | Magnetic carrier 1 | Two-component developer 6 |
| Example 107 | Toner 7 | Magnetic carrier 1 | Two-component developer 7 |
| Example 108 | Toner 8 | Magnetic carrier 1 | Two-component developer 8 |
| Example 109 | Toner 9 | Magnetic carrier 1 | Two-component developer 9 |
| Example 110 | Toner 10 | Magnetic carrier 1 | Two-component developer 10 |
| Example 111 | Toner 11 | Magnetic carrier 1 | Two-component developer 11 |
| Example 112 | Toner 12 | Magnetic carrier 1 | Two-component developer 12 |
| Example 113 | Toner 13 | Magnetic carrier 1 | Two-component developer 13 |
| Example 114 | Toner 14 | Magnetic carrier 1 | Two-component developer 14 |
| Example 115 | Toner 15 | Magnetic carrier 1 | Two-component developer 15 |
| Example 116 | Toner 16 | Magnetic carrier 1 | Two-component developer 16 |
| Example 117 | Toner 17 | Magnetic carrier 1 | Two-component developer 17 |
| Example 118 | Toner 18 | Magnetic carrier 1 | Two-component developer 18 |
| Example 119 | Toner 19 | Magnetic carrier 1 | Two-component developer 19 |
| Example 120 | Toner 20 | Magnetic carrier 1 | Two-component developer 20 |
| Example 121 | Toner 21 | Magnetic carrier 1 | Two-component developer 21 |
| Example 122 | Toner 22 | Magnetic carrier 1 | Two-component developer 22 |
| Example 123 | Toner 23 | Magnetic carrier 1 | Two-component developer 23 |
| Example 124 | Toner 24 | Magnetic carrier 1 | Two-component developer 24 |
| Example 125 | Toner 25 | Magnetic carrier 1 | Two-component developer 25 |
| Example 126 | Toner 26 | Magnetic carrier 1 | Two-component developer 26 |
| Example 127 | Toner 27 | Magnetic carrier 1 | Two-component developer 27 |
| Example 128 | Toner 28 | Magnetic carrier 1 | Two-component developer 28 |
| Example 129 | Toner 29 | Magnetic carrier 1 | Two-component developer 29 |
| Example 130 | Toner 30 | Magnetic carrier 1 | Two-component developer 30 |
| Example 131 | Toner 31 | Magnetic carrier 1 | Two-component developer 31 |
| Example 132 | Toner 32 | Magnetic carrier 1 | Two-component developer 32 |
| Example 133 | Toner 33 | Magnetic carrier 1 | Two-component developer 33 |
| Example 134 | Toner 34 | Magnetic carrier 1 | Two-component developer 34 |
| Example 135 | Toner 35 | Magnetic carrier 1 | Two-component developer 35 |
| Example 136 | Toner 36 | Magnetic carrier 1 | Two-component developer 36 |
| Example 137 | Toner 37 | Magnetic carrier 1 | Two-component developer 37 |
| Example 138 | Toner 38 | Magnetic carrier 1 | Two-component developer 38 |
| Example 139 | Toner 39 | Magnetic carrier 1 | Two-component developer 39 |
| Comparative Example 101 | Toner 40 | Magnetic carrier 1 | Two-component developer 40 |
| Comparative Example 102 | Toner 41 | Magnetic carrier 1 | Two-component developer 41 |
| Comparative Example 103 | Toner 42 | Magnetic carrier 1 | Two-component developer 42 |
| Comparative Example 104 | Toner 43 | Magnetic carrier 1 | Two-component developer 43 |
| Comparative Example 105 | Toner 44 | Magnetic carrier 1 | Two-component developer 44 |
| Comparative Example 106 | Toner 45 | Magnetic carrier 1 | Two-component developer 45 |
| Comparative Example 107 | Toner 46 | Magnetic carrier 1 | Two-component developer 46 |
| Comparative Example 108 | Toner 47 | Magnetic carrier 1 | Two-component developer 47 |
| Comparative Example 109 | Toner 48 | Magnetic carrier 1 | Two-component developer 48 |
| Comparative Example 110 | Toner 49 | Magnetic carrier 1 | Two-component developer 49 |
| Comparative Example 111 | Toner 50 | Magnetic carrier 1 | Two-component developer 50 |
| Comparative Example 112 | Toner 51 | Magnetic carrier 1 | Two-component developer 51 |
| Comparative Example 113 | Toner 52 | Magnetic carrier 1 | Two-component developer 52 |
| Comparative Example 114 | Toner 53 | Magnetic carrier 1 | Two-component developer 53 |

TABLE 9

(under normal-temperature and normal-humidity environment)

| | Image density | | | | Fogging | | | |
|---|---|---|---|---|---|---|---|---|
| | First sheet | 5,000-th sheet | Density difference Δ | Rank | First sheet | Rank | 5,000-th sheet | Rank |
| Example 101 | 1.50 | 1.48 | 0.02 | A | 0.1 | A | 0.2 | A |
| Example 102 | 1.50 | 1.48 | 0.02 | A | 0.1 | A | 0.2 | A |
| Example 103 | 1.50 | 1.48 | 0.02 | A | 0.1 | A | 0.2 | A |
| Example 104 | 1.50 | 1.48 | 0.02 | A | 0.1 | A | 0.3 | A |
| Example 105 | 1.50 | 1.48 | 0.02 | A | 0.1 | A | 0.3 | A |
| Example 106 | 1.50 | 1.47 | 0.03 | A | 0.2 | A | 0.6 | B |
| Example 107 | 1.50 | 1.47 | 0.03 | A | 0.2 | A | 0.6 | B |
| Example 108 | 1.50 | 1.47 | 0.03 | A | 0.2 | A | 0.6 | B |
| Example 109 | 1.50 | 1.47 | 0.03 | A | 0.2 | A | 0.6 | B |
| Example 110 | 1.50 | 1.47 | 0.03 | A | 0.2 | A | 0.6 | B |
| Example 111 | 1.50 | 1.47 | 0.03 | A | 0.2 | A | 0.6 | B |
| Example 112 | 1.50 | 1.47 | 0.03 | A | 0.2 | A | 0.6 | B |
| Example 113 | 1.50 | 1.47 | 0.03 | A | 0.2 | A | 0.6 | B |
| Example 114 | 1.50 | 1.42 | 0.08 | B | 0.5 | B | 1.6 | C |
| Example 115 | 1.50 | 1.42 | 0.08 | B | 0.6 | B | 1.0 | C |
| Example 116 | 1.50 | 1.47 | 0.03 | A | 0.2 | A | 0.5 | B |
| Example 117 | 1.50 | 1.47 | 0.03 | A | 0.2 | A | 0.5 | B |
| Example 118 | 1.50 | 1.47 | 0.03 | A | 0.2 | A | 0.6 | B |
| Example 119 | 1.50 | 1.45 | 0.05 | B | 0.6 | B | 1.2 | C |
| Example 120 | 1.50 | 1.46 | 0.04 | A | 0.2 | A | 0.6 | B |
| Example 121 | 1.50 | 1.42 | 0.08 | B | 0.4 | A | 0.9 | B |
| Example 122 | 1.50 | 1.44 | 0.06 | B | 0.3 | A | 0.7 | B |
| Example 123 | 1.50 | 1.42 | 0.08 | B | 0.6 | B | 1.0 | C |
| Example 124 | 1.50 | 1.46 | 0.04 | A | 0.2 | A | 0.6 | B |
| Example 125 | 1.50 | 1.47 | 0.03 | A | 0.2 | A | 0.5 | B |
| Example 126 | 1.50 | 1.44 | 0.06 | B | 0.4 | A | 0.9 | B |
| Example 127 | 1.50 | 1.42 | 0.08 | B | 0.4 | A | 0.9 | B |
| Example 128 | 1.50 | 1.42 | 0.08 | B | 0.5 | B | 1.0 | C |
| Example 129 | 1.50 | 1.42 | 0.08 | B | 0.6 | B | 1.2 | C |
| Example 130 | 1.50 | 1.41 | 0.09 | B | 0.6 | B | 1.2 | C |
| Example 131 | 1.50 | 1.43 | 0.07 | B | 0.5 | B | 1.0 | C |
| Example 132 | 1.50 | 1.46 | 0.04 | A | 0.2 | A | 0.6 | B |
| Example 133 | 1.50 | 1.41 | 0.09 | B | 0.8 | B | 1.4 | C |
| Example 134 | 1.50 | 1.44 | 0.06 | B | 0.4 | A | 0.7 | B |
| Example 135 | 1.50 | 1.43 | 0.07 | B | 0.5 | B | 0.9 | B |
| Example 136 | 1.50 | 1.40 | 0.10 | C | 0.7 | B | 1.2 | C |
| Example 137 | 1.50 | 1.46 | 0.04 | A | 0.2 | A | 0.8 | B |
| Example 138 | 1.50 | 1.46 | 0.04 | A | 0.3 | A | 0.7 | B |
| Example 139 | 1.50 | 1.47 | 0.03 | A | 0.2 | A | 0.6 | B |
| Comparative Example 101 | 1.50 | 1.37 | 0.13 | C | 1.2 | C | 2.1 | D |
| Comparative Example 102 | 1.50 | 1.47 | 0.03 | A | 0.2 | A | 0.5 | B |
| Comparative Example 103 | 1.50 | 1.42 | 0.08 | B | 1.0 | C | 1.8 | C |
| Comparative Example 104 | 1.50 | 1.42 | 0.08 | B | 0.6 | B | 1.2 | C |
| Comparative Example 105 | 1.50 | 1.41 | 0.09 | B | 0.7 | B | 1.4 | C |
| Comparative Example 106 | 1.50 | 1.46 | 0.04 | A | 0.2 | A | 0.5 | B |
| Comparative Example 107 | 1.50 | 1.35 | 0.15 | D | 0.6 | B | 2.2 | D |
| Comparative Example 108 | 1.50 | 1.33 | 0.17 | D | 1.1 | C | 2.0 | D |
| Comparative Example 109 | 1.50 | 1.33 | 0.17 | D | 1.5 | C | 2.5 | D |
| Comparative Example 110 | 1.50 | 1.40 | 0.10 | C | 1.2 | C | 2.0 | D |
| Comparative Example 111 | 1.50 | 1.37 | 0.13 | C | 1.5 | C | 2.2 | D |
| Comparative Example 112 | 1.50 | 1.35 | 0.15 | D | 1.3 | C | 2.3 | D |
| Comparative Example 113 | 1.50 | 1.40 | 0.10 | C | 1.0 | C | 1.8 | C |
| Comparative Example 114 | 1.50 | 1.38 | 0.12 | C | 1.5 | C | 1.8 | C |

TABLE 10

(under normal-temperature and low-humidity environment)

| | Image density | | | | Fogging | | | |
|---|---|---|---|---|---|---|---|---|
| | First sheet | 5,000-th sheet | Density difference Δ | Rank | First sheet | Rank | 5,000-th sheet | Rank |
| Example 101 | 1.50 | 1.48 | 0.02 | A | 0.1 | A | 0.2 | A |
| Example 102 | 1.50 | 1.48 | 0.02 | A | 0.1 | A | 0.2 | A |
| Example 103 | 1.50 | 1.48 | 0.02 | A | 0.1 | A | 0.3 | A |
| Example 104 | 1.50 | 1.48 | 0.02 | A | 0.1 | A | 0.3 | A |
| Example 105 | 1.50 | 1.47 | 0.03 | A | 0.2 | A | 0.6 | B |
| Example 106 | 1.50 | 1.47 | 0.03 | A | 0.2 | A | 0.6 | B |
| Example 107 | 1.50 | 1.47 | 0.03 | A | 0.2 | A | 0.6 | B |
| Example 108 | 1.50 | 1.47 | 0.03 | A | 0.2 | A | 0.6 | B |
| Example 109 | 1.50 | 1.47 | 0.03 | A | 0.2 | A | 0.6 | B |
| Example 110 | 1.50 | 1.47 | 0.03 | A | 0.2 | A | 0.6 | B |
| Example 111 | 1.50 | 1.47 | 0.03 | A | 0.2 | A | 0.6 | B |
| Example 112 | 1.50 | 1.47 | 0.03 | A | 0.2 | A | 0.6 | B |
| Example 113 | 1.50 | 1.42 | 0.08 | B | 0.5 | B | 1.6 | C |
| Example 114 | 1.50 | 1.42 | 0.08 | B | 0.6 | B | 1.0 | C |
| Example 115 | 1.50 | 1.47 | 0.03 | A | 0.2 | A | 0.5 | B |
| Example 116 | 1.50 | 1.47 | 0.03 | A | 0.2 | A | 0.5 | B |
| Example 117 | 1.50 | 1.47 | 0.03 | A | 0.2 | A | 0.6 | B |
| Example 118 | 1.50 | 1.45 | 0.05 | B | 0.6 | B | 1.2 | C |
| Example 119 | 1.50 | 1.46 | 0.04 | A | 0.2 | A | 0.6 | B |
| Example 120 | 1.50 | 1.42 | 0.08 | B | 0.4 | A | 0.9 | B |
| Example 121 | 1.50 | 1.44 | 0.06 | B | 0.3 | A | 0.7 | B |
| Example 122 | 1.50 | 1.42 | 0.08 | B | 0.6 | B | 1.0 | C |
| Example 123 | 1.50 | 1.46 | 0.04 | A | 0.2 | A | 0.6 | B |
| Example 124 | 1.50 | 1.47 | 0.03 | A | 0.2 | A | 0.5 | B |
| Example 125 | 1.50 | 1.44 | 0.06 | B | 0.4 | A | 0.9 | B |
| Example 126 | 1.50 | 1.42 | 0.08 | B | 0.4 | A | 0.9 | B |
| Example 127 | 1.50 | 1.42 | 0.08 | B | 0.5 | B | 1.0 | C |
| Example 128 | 1.50 | 1.42 | 0.08 | B | 0.6 | B | 1.2 | C |
| Example 129 | 1.50 | 1.41 | 0.09 | B | 0.6 | B | 1.2 | C |
| Example 130 | 1.50 | 1.43 | 0.07 | B | 0.5 | B | 1.0 | C |
| Example 131 | 1.50 | 1.46 | 0.04 | A | 0.2 | A | 0.6 | B |
| Example 132 | 1.50 | 1.41 | 0.09 | B | 0.8 | B | 1.4 | C |
| Example 133 | 1.50 | 1.44 | 0.06 | B | 0.4 | A | 0.7 | B |
| Example 134 | 1.50 | 1.43 | 0.07 | B | 0.5 | B | 0.9 | B |
| Example 135 | 1.50 | 1.40 | 0.10 | C | 0.7 | B | 1.2 | C |
| Example 136 | 1.50 | 1.46 | 0.04 | A | 0.2 | A | 0.8 | B |
| Example 137 | 1.50 | 1.46 | 0.04 | A | 0.3 | A | 0.7 | B |
| Example 138 | 1.50 | 1.47 | 0.03 | A | 0.2 | A | 0.6 | B |
| Comparative Example 101 | 1.50 | 1.37 | 0.13 | C | 1.2 | C | 2.1 | D |
| Comparative Example 102 | 1.50 | 1.47 | 0.03 | A | 0.2 | A | 0.5 | B |
| Comparative Example 103 | 1.50 | 1.42 | 0.08 | B | 1.0 | C | 2.0 | D |
| Comparative Example 104 | 1.50 | 1.42 | 0.08 | B | 0.6 | B | 1.2 | C |
| Comparative Example 105 | 1.50 | 1.41 | 0.09 | B | 0.7 | B | 1.4 | C |
| Comparative Example 106 | 1.50 | 1.46 | 0.04 | A | 0.2 | A | 0.5 | B |
| Comparative Example 107 | 1.50 | 1.35 | 0.15 | D | 0.6 | B | 2.2 | D |
| Comparative Example 108 | 1.50 | 1.33 | 0.17 | D | 1.1 | C | 2.0 | D |
| Comparative Example 109 | 1.50 | 1.33 | 0.17 | D | 1.5 | C | 2.5 | D |
| Comparative Example 110 | 1.50 | 1.40 | 0.10 | C | 1.2 | C | 2.0 | D |
| Comparative Example 111 | 1.50 | 1.37 | 0.13 | C | 1.5 | C | 2.2 | D |
| Comparative Example 112 | 1.50 | 1.35 | 0.15 | D | 1.3 | C | 2.3 | D |
| Comparative Example 113 | 1.50 | 1.40 | 0.10 | C | 1.0 | C | 2.0 | D |
| Comparative Example 114 | 1.50 | 1.38 | 0.12 | C | 1.5 | C | 2.0 | D |

TABLE 11

(under high-temperature and high-humidity environment)

| | Image density | | | | Fogging | | | |
|---|---|---|---|---|---|---|---|---|
| | First sheet | 5,000-th sheet | Density difference Δ | Rank | First sheet | Rank | 5,000-th sheet | Rank |
| Example 101 | 1.50 | 1.48 | 0.02 | A | 0.1 | A | 0.2 | A |
| Example 102 | 1.50 | 1.47 | 0.03 | A | 0.2 | A | 0.4 | A |
| Example 103 | 1.50 | 1.47 | 0.03 | A | 0.2 | A | 0.4 | A |
| Example 104 | 1.50 | 1.47 | 0.03 | A | 0.2 | A | 0.4 | A |
| Example 105 | 1.50 | 1.47 | 0.03 | A | 0.2 | A | 0.4 | A |
| Example 106 | 1.50 | 1.46 | 0.04 | A | 0.3 | A | 0.7 | B |
| Example 107 | 1.50 | 1.46 | 0.04 | A | 0.3 | A | 0.7 | B |
| Example 108 | 1.50 | 1.46 | 0.04 | A | 0.3 | A | 0.7 | B |
| Example 109 | 1.50 | 1.46 | 0.04 | A | 0.3 | A | 0.7 | B |
| Example 110 | 1.50 | 1.46 | 0.04 | A | 0.3 | A | 0.7 | B |
| Example 111 | 1.50 | 1.46 | 0.04 | A | 0.3 | A | 0.7 | B |
| Example 112 | 1.50 | 1.46 | 0.04 | A | 0.3 | A | 0.7 | B |
| Example 113 | 1.50 | 1.46 | 0.04 | A | 0.3 | A | 0.7 | B |
| Example 114 | 1.50 | 1.42 | 0.08 | B | 0.6 | B | 1.8 | C |
| Example 115 | 1.50 | 1.41 | 0.09 | B | 0.7 | B | 1.2 | C |
| Example 116 | 1.50 | 1.46 | 0.04 | A | 0.3 | A | 0.6 | B |
| Example 117 | 1.50 | 1.46 | 0.04 | A | 0.3 | A | 0.6 | B |
| Example 118 | 1.50 | 1.46 | 0.04 | A | 0.3 | A | 0.7 | B |
| Example 119 | 1.50 | 1.44 | 0.06 | B | 0.7 | B | 1.4 | C |
| Example 120 | 1.50 | 1.45 | 0.05 | B | 0.3 | A | 0.7 | B |
| Example 121 | 1.50 | 1.41 | 0.09 | B | 0.5 | B | 1.1 | C |
| Example 122 | 1.50 | 1.43 | 0.07 | B | 0.4 | A | 0.9 | B |
| Example 123 | 1.50 | 1.41 | 0.09 | B | 0.8 | B | 1.2 | C |
| Example 124 | 1.50 | 1.45 | 0.05 | B | 0.3 | A | 0.7 | B |
| Example 125 | 1.50 | 1.46 | 0.04 | A | 0.3 | A | 0.7 | B |
| Example 126 | 1.50 | 1.43 | 0.07 | B | 0.5 | B | 1.1 | C |
| Example 127 | 1.50 | 1.41 | 0.09 | B | 0.5 | B | 1.0 | C |
| Example 128 | 1.50 | 1.41 | 0.09 | B | 0.6 | B | 1.2 | C |
| Example 129 | 1.50 | 1.41 | 0.09 | B | 0.7 | B | 1.4 | C |
| Example 130 | 1.50 | 1.40 | 0.10 | C | 0.7 | B | 1.4 | C |
| Example 131 | 1.50 | 1.42 | 0.08 | B | 0.6 | B | 1.2 | C |
| Example 132 | 1.50 | 1.45 | 0.05 | B | 0.3 | A | 0.7 | B |
| Example 133 | 1.50 | 1.43 | 0.07 | B | 0.9 | B | 1.4 | C |
| Example 134 | 1.50 | 1.43 | 0.07 | B | 0.5 | B | 0.8 | B |
| Example 135 | 1.50 | 1.42 | 0.08 | B | 0.7 | B | 0.9 | B |
| Example 136 | 1.50 | 1.38 | 0.12 | C | 0.9 | B | 1.3 | C |
| Example 137 | 1.50 | 1.46 | 0.04 | A | 0.3 | A | 0.9 | B |
| Example 138 | 1.50 | 1.45 | 0.05 | B | 0.4 | A | 0.8 | B |
| Example 139 | 1.50 | 1.46 | 0.04 | A | 0.3 | A | 0.7 | B |
| Comparative Example 101 | 1.50 | 1.33 | 0.17 | D | 1.4 | C | 2.5 | D |
| Comparative Example 102 | 1.50 | 1.46 | 0.04 | A | 0.4 | A | 0.8 | B |
| Comparative Example 103 | 1.50 | 1.42 | 0.08 | B | 1.2 | C | 2.2 | D |
| Comparative Example 104 | 1.50 | 1.41 | 0.09 | B | 0.8 | B | 1.4 | C |
| Comparative Example 105 | 1.50 | 1.37 | 0.13 | C | 1.0 | C | 2.0 | D |
| Comparative Example 106 | 1.50 | 1.45 | 0.05 | B | 0.3 | A | 0.7 | B |
| Comparative Example 107 | 1.50 | 1.32 | 0.18 | D | 0.7 | B | 2.5 | D |
| Comparative Example 108 | 1.50 | 1.30 | 0.20 | D | 1.3 | C | 2.3 | D |
| Comparative Example 109 | 1.50 | 1.31 | 0.19 | D | 2.0 | D | 3.0 | D |
| Comparative Example 110 | 1.50 | 1.38 | 0.12 | C | 1.6 | C | 2.6 | D |
| Comparative Example 111 | 1.50 | 1.35 | 0.15 | D | 1.8 | C | 2.4 | D |
| Comparative Example 112 | 1.50 | 1.33 | 0.17 | D | 1.5 | C | 2.6 | D |
| Comparative Example 113 | 1.50 | 1.38 | 0.12 | C | 1.5 | C | 3.5 | D |
| Comparative Example 114 | 1.50 | 1.36 | 0.14 | C | 1.8 | C | 2.4 | D |

TABLE 12

| | Low-temperature fixability | Rank | Hot offset resistance | Rank |
|---|---|---|---|---|
| Example 101 | 135° C. | A | 215° C. | A |
| Example 102 | 135° C. | A | 215° C. | A |
| Example 103 | 135° C. | A | 210° C. | A |
| Example 104 | 135° C. | A | 210° C. | A |
| Example 105 | 135° C. | A | 205° C. | B |
| Example 106 | 135° C. | A | 210° C. | A |
| Example 107 | 135° C. | A | 200° C. | B |
| Example 108 | 135° C. | A | 200° C. | B |
| Example 109 | 135° C. | A | 200° C. | B |
| Example 110 | 135° C. | A | 200° C. | B |
| Example 111 | 130° C. | A | 200° C. | B |
| Example 112 | 130° C. | A | 200° C. | B |
| Example 113 | 140° C. | B | 200° C. | B |
| Example 114 | 140° C. | B | 200° C. | B |
| Example 115 | 140° C. | B | 190° C. | C |
| Example 116 | 140° C. | B | 205° C. | B |
| Example 117 | 140° C. | B | 210° C. | A |
| Example 118 | 140° C. | B | 200° C. | B |
| Example 119 | 140° C. | B | 195° C. | C |
| Example 120 | 145° C. | B | 205° C. | B |
| Example 121 | 155° C. | C | 210° C. | A |
| Example 122 | 135° C. | A | 200° C. | B |
| Example 123 | 130° C. | A | 195° C. | C |
| Example 124 | 145° C. | B | 200° C. | B |
| Example 125 | 150° C. | C | 205° C. | B |
| Example 126 | 140° C. | B | 200° C. | B |
| Example 127 | 140° C. | B | 200° C. | B |
| Example 128 | 140° C. | B | 200° C. | B |
| Example 129 | 140° C. | B | 200° C. | B |
| Example 130 | 140° C. | B | 205° C. | B |
| Example 131 | 140° C. | B | 200° C. | B |
| Example 132 | 130° C. | A | 200° C. | B |
| Example 133 | 140° C. | B | 200° C. | B |
| Example 134 | 140° C. | B | 200° C. | B |
| Example 135 | 140° C. | B | 200° C. | B |
| Example 136 | 140° C. | B | 200° C. | B |
| Example 137 | 140° C. | B | 200° C. | B |
| Example 138 | 140° C. | B | 200° C. | B |
| Example 139 | 140° C. | B | 200° C. | B |
| Comparative Example 101 | 130° C. | A | 175° C. | D |
| Comparative Example 102 | 165° C. | D | 210° C. | A |
| Comparative Example 103 | 135° C. | A | 180° C. | D |
| Comparative Example 104 | 160° C. | D | 210° C. | A |
| Comparative Example 105 | 130° C. | A | 180° C. | D |
| Comparative Example 106 | 165° C. | D | 210° C. | A |
| Comparative Example 107 | 135° C. | A | 200° C. | B |
| Comparative Example 108 | 145° C. | B | 210° C. | A |
| Comparative Example 109 | 150° C. | C | 205° C. | B |
| Comparative Example 110 | 140° C. | B | 200° C. | B |
| Comparative Example 111 | 140° C. | B | 195° C. | C |
| Comparative Example 112 | 140° C. | B | 205° C. | B |
| Comparative Example 113 | 135° C. | A | 205° C. | B |
| Comparative Example 114 | 135° C. | A | 200° C. | B |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-269462, filed Dec. 26, 2013, which is hereby incorporated by reference herein in its entirety.

What is claimed is:

1. A toner comprising:

a binder resin;

a colorant; and a wax, the toner being obtained through a step of melting and kneading the binder resin, the colorant, and the wax, wherein:

the binder resin comprises:

a polyester resin A having a polyhydric alcohol unit and a polyvalent carboxylic acid unit, and a polyester resin B having a polyhydric alcohol unit and a polyvalent carboxylic acid unit;

a mass ratio (polyester resin A/polyester resin B) of the polyester resin A to the polyester resin B is from 10/90 or more to 60/40 or less;

the polyester resin A has a softening point of from 120° C. or more to 180° C. or less;

the polyester resin A contains 90 mol % or more of a polyhydric alcohol unit derived from an aromatic diol with respect to a total number of moles of the polyhydric alcohol unit, and contains 0.1 mol % or more to 10.0 mol % or less of a polyhydric alcohol unit derived from an oxyalkylene ether of a novolac type phenol resin with respect thereto;

the polyester resin A contains 15 mol % or more to 50 mol % or less of a polyvalent carboxylic acid unit derived from an aliphatic dicarboxylic acid, which contains a straight-chain hydrocarbon having 4 or more to 16 or less carbon atoms as a main chain and has carboxyl groups at both terminals of the main chain, with respect to a total number of moles of the polyvalent carboxylic acid unit;

the polyester resin B has a softening point of from 80° C. or more to 100° C. or less;

the polyester resin B contains 90 mol % or more of a polyhydric alcohol unit derived from an aromatic diol with respect to a total number of moles of the polyhydric alcohol unit;

the polyester resin B contains 90 mol % or more of a polyvalent carboxylic acid unit derived from one of an aromatic dicarboxylic acid and a derivative thereof with respect to a total number of moles of the polyvalent carboxylic acid unit; and the polyester resin B contains 0.1 mol % or more to 10.0 mol % or less of a polyvalent carboxylic acid unit derived from one of an aliphatic dicarboxylic acid and a derivative thereof with respect to the total number of moles of the polyvalent carboxylic acid unit.

2. The toner according to claim 1, wherein a glass transition temperature Tg(80) of the polyester resin A measured with a differential scanning calorimeter (DSC) by increasing a temperature of the resin to 80° C. once, then reducing the temperature to 30° C., and then increasing the temperature again, and a glass transition temperature Tg(180) of the resin measured with the differential scanning calorimeter (DSC) by increasing the temperature to 180° C. once, then reducing the temperature to 30° C., and then increasing the temperature again have a relationship represented by the following mathematical expression (1)

$$-1.0 \leq Tg(80) - Tg(180) \leq 1.0 \quad (1).$$

3. The toner according to claim 1, wherein the wax comprises a hydrocarbon wax.

4. The toner according to claim 1, wherein the binder resin further comprises a polymer C having a structure in which a vinyl-based resin component and a hydrocarbon compound are bonded to each other.

5. A two-component developer, comprising:

the toner according to claim 1; and a magnetic carrier.

6. The two-component developer according to claim 5, wherein a concentration of the toner in the two-component developer is from 2 mass % or more to 15 mass % or less.

* * * * *